United States Patent [19]

Shimizu et al.

[11] Patent Number: 5,037,218

[45] Date of Patent: Aug. 6, 1991

[54] THERMAL TRANSFER PRINTER CAPABLE OF USING AND DETECTING A PLURALITY OF MULTICOLOR RIBBONS

[75] Inventors: Hiroshi Shimizu; Naohiro Ozawa, both of Yokohama; Toshihiko Gotoh, Tokyo; Kentaro Hanma, Yokohama; Seiji Okunomiya, Katsuta; Tetsuo Nakano, Yokohama, all of Japan

[73] Assignee: Hitachi, Ltd., Tokyo, Japan

[21] Appl. No.: 283,536

[22] Filed: Dec. 9, 1988

[30] Foreign Application Priority Data

Dec. 14, 1987 [JP] Japan ..... 62-314009
Dec. 14, 1987 [JP] Japan ..... 62-314011

[51] Int. Cl.[5] ..... B41J 35/16

[52] U.S. Cl. ..... 400/237; 400/120; 400/240.3

[58] Field of Search ..... 400/120, 225, 240.3, 400/120 MP, 237 E

[56] References Cited

U.S. PATENT DOCUMENTS

| | | | |
|---|---|---|---|
| 4,492,965 | 1/1985 | Ohnishi | 400/120 |
| 4,495,507 | 1/1985 | Moriguchi | 400/120 |
| 4,502,057 | 2/1985 | Kawano | 400/120 |
| 4,586,834 | 5/1986 | Hachisuga | 400/240.3 |
| 4,594,597 | 6/1986 | Liu | 400/240.3 |
| 4,638,330 | 1/1987 | Watanabe | 400/120 |
| 4,642,655 | 2/1987 | Sparer | 400/240.3 |
| 4,687,359 | 8/1987 | Barrus | 400/225 |
| 4,710,781 | 12/1987 | Stephenson | 400/120 |
| 4,794,404 | 12/1988 | Shiraishi | 400/120 |

FOREIGN PATENT DOCUMENTS

| | | | |
|---|---|---|---|
| 154193 | 12/1980 | Japan | 400/240.3 |
| 154093 | 8/1985 | Japan | 400/120 MC |
| 155477 | 8/1985 | Japan | 400/120 MC |
| 172784 | 8/1986 | Japan | 400/240.3 |
| 217278 | 9/1986 | Japan | 400/240.3 |
| 134284 | 6/1987 | Japan | 400/240.3 |
| 169679 | 7/1987 | Japan | 400/240.3 |
| 31783 | 2/1988 | Japan | 400/225 E |

OTHER PUBLICATIONS

I.B.M. Technical Disclosure Bulletin, vol. 22, No. 7, Dec. 1979, pp. 2633–2635.

*Primary Examiner*—David A. Wiecking
*Assistant Examiner*—Steven S. Kelley
*Attorney, Agent, or Firm*—Antonelli, Terry, Stout & Kraus

[57] ABSTRACT

A thermal transfer printer which can use both an ink sheet provided with a positioning mark to indicate the top position of a set of three color ink patches necessary for producing one image, and an ink sheet provided with no such positioning mark, without the need of switching the operation mode. The thermal transfer printer has an optical sensor which can equally detect color change between 3rd and 1st color patches for the ink sheet provided with no positioning mark and color change between a positioning mark and 1st color patch for the ink sheet provided with the positioning mark. There is also disclosed an ink sheet cassette for use in the thermal transfer printer, the ink sheet cassette accommodating the ink sheet in which a positioning mark is coated with the same color(s) of ink as those for printing and information about the color sequence of the ink coated patches for printing is also recorded in the coated pattern of the positioning mark.

17 Claims, 23 Drawing Sheets

FIG. 10a
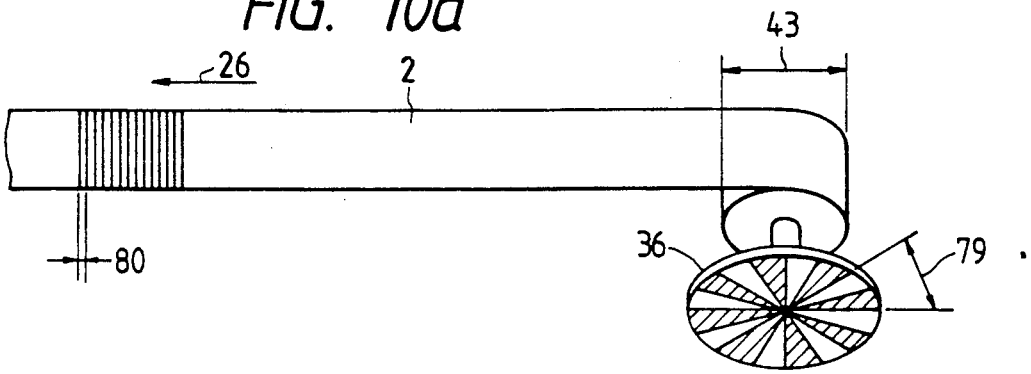
FIG. 10b
| | | | | | | | | | | | | | | | |
|---|---|---|---|---|---|---|---|---|---|---|---|---|---|---|---|
| LSB | 1 | 0 | | | | | 1 | 0 | | | | | 1 | | |
| | 1 | 0 | | | | | 1 | 0 | | | | | 1 | | |
| | 1 | 0 | | | | | 1 | 0 | | | | | 1 | | |
| | 1 | 0 | | | | | 1 | 0 | | | | | 1 | | |
| | 1 | 0 | | | | | 0 | 1 | | | | | 1 | | |
| MSB | 0 | 1 | | | | | 1 | 1 | | | | | 1 | | |
| TEN UNIT NUMBER | 31 | 32 | | | | | 47 | 48 | | | | | 63 | | |
FIG. 10c
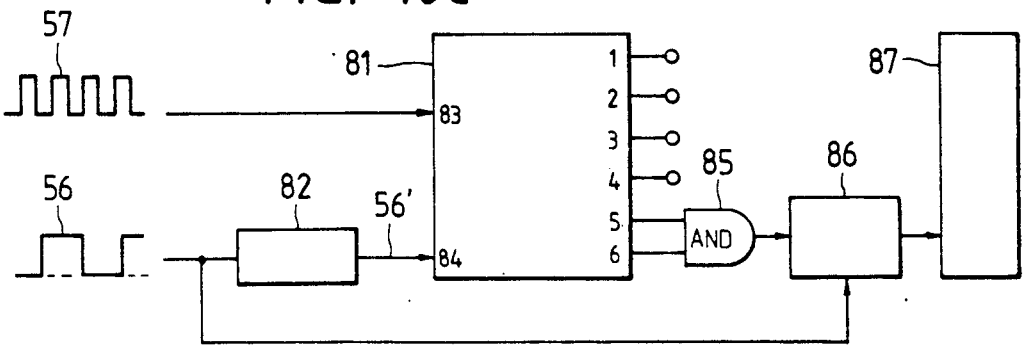

| | RED | GREEN | BLUE | INFRA-RED |
|---|---|---|---|---|
| CYAN | L | H | H | L |
| MAGENTA | H | L | H | H |
| YELLOW | H | H | L | H |
| CLEAR | H | H | H | H |
| BLACK | L | L | L | L |

107

108

| INK COLOR / LIGHT SOURCE | YELLOW | MAGENTA | CYAN | CLEAR PART |
|---|---|---|---|---|
| RED | H(ON) | H | L(OFF) | H |
| GREEN | H | L | L | H |

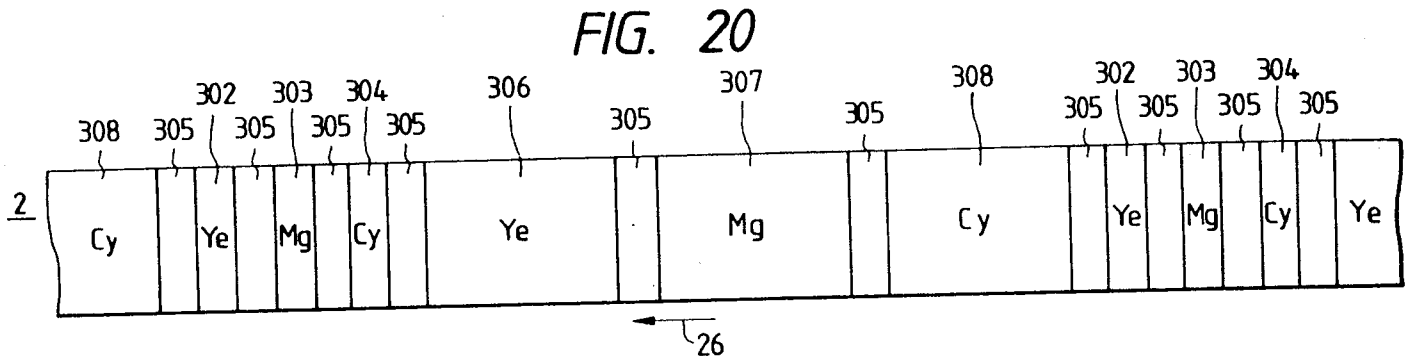
FIG. 20
Cy
Ye
Mg
Ye
Cy
Mg
Ye
Cy
Ye
308
305
302
305
303
305
304
305
306
305
307
305
308
305
302
305
303
305
304
305
2
26

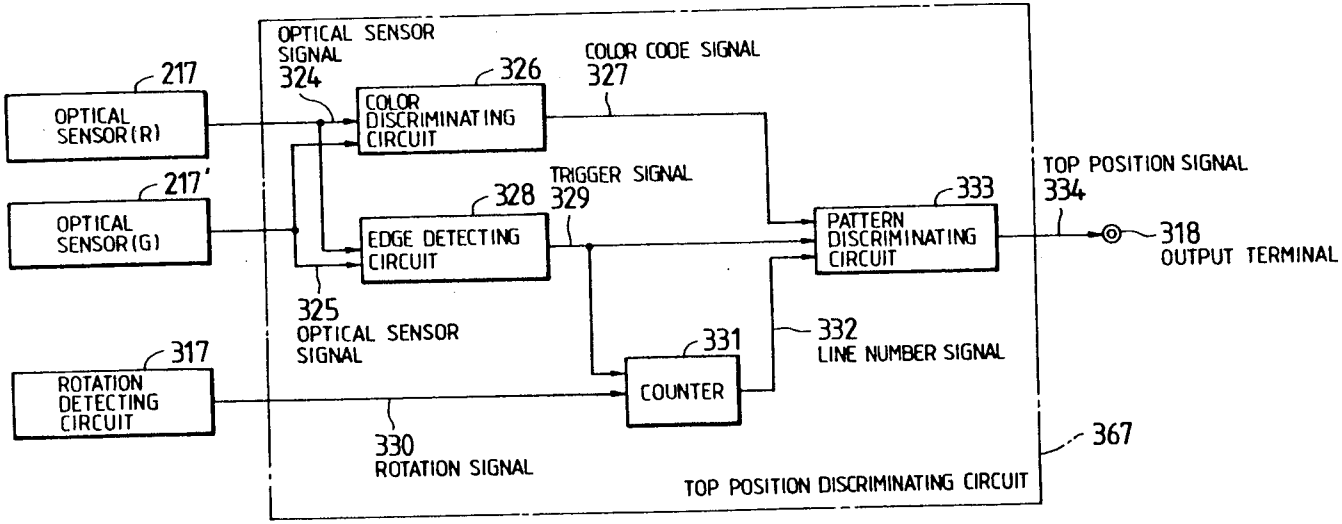
FIG. 21
OPTICAL SENSOR SIGNAL 324
COLOR CODE SIGNAL 327
TRIGGER SIGNAL 329
OPTICAL SENSOR SIGNAL 325
ROTATION SIGNAL 330
LINE NUMBER SIGNAL 332
TOP POSITION SIGNAL 334
OUTPUT TERMINAL 318
TOP POSITION DISCRIMINATING CIRCUIT 367
OPTICAL SENSOR (R) 217
OPTICAL SENSOR (G) 217'
ROTATION DETECTING CIRCUIT 317
COLOR DISCRIMINATING CIRCUIT 326
EDGE DETECTING CIRCUIT 328
PATTERN DISCRIMINATING CIRCUIT 333
COUNTER 331

THERMAL TRANSFER PRINTER CAPABLE OF USING AND DETECTING A PLURALITY OF MULTICOLOR RIBBONS

BACKGROUND OF THE INVENTION

The present invention relates to a thermal transfer printer for recording an image on printing paper by the use of an ink sheet, and more particularly to a thermal transfer printer adapted to initialize a set of color patches (or position 1st color ink) at start-up of printing, and an ink sheet cassette for use in the printer.

To date, there is known a thermal transfer printer designed to print a color image on printing paper by the use of an ink sheet on which different colors of ink are coated on respective predetermined areas. This type thermal transfer printer utilizes a sequential color plane printing method in which an ink sheet coated with ink corresponding to one picture for each of complementary colors to primary colors of light, i.e., yellow (Ye), magenta (Mg) and cyan (Cy), is used to sequentially print those three colors of ink on printing paper. This sequential color plate printing method requires one to initialize a set of color patches immediately before start-up of printing. One of the conventional initializing methods is described in Japanese Patent Laid-Open No. 59-143674 (1984). According to this conventional method, a bar code is provided in a spacing between one ink color and the other ink color on an ink sheet, and color discriminating means for sensing the color represented by the color code is employed to sense the ink color on the ink sheet and then position 1st color ink. Incidentally, the bar code is formed using black ink. The color discriminating means comprises an infrared sensor.

When manufacturing ink sheets, however, the above-mentioned prior art employs four colors of ink, i.e., yellow, magenta and cyan, as well as black for the bar code (positioning mark). Accordingly, there are needed four types of printing drums for manufacturing an ink sheet, resulting in a problem that the printing cost of the ink sheet is increased.

The foregoing prior art includes another problem in that an ink sheet comprising only three colors of ink cannot be used in thermal transfer printers designed for an ink sheet comprising four colors, because the former ink sheet has no positioning mark.

SUMMARY OF THE INVENTION

It is an object of the present invention to provide a thermal transfer printer which can initialize a set of color patches (or position 1st color ink) for both an ink sheet having a positioning mark in black color and an ink sheet having no positioning mark, and which includes positioning means adapted to position 2nd and 3rd color patches of the ink sheet.

Another object of the present invention is to provide an ink sheet cassette which accommodates therein an ink sheet and indicates a top or head position of the ink sheet using only three colors of ink for printing.

To achieve the above objects, the present invention includes color discriminating means with which color changes between 3rd and 1st color patches on an ink sheet and color changes between a black positioning mark and 1st color patch on the ink sheet are detected and issued as output signals of similar nature, and transport means for transporting 2nd and 3rd color patches on the ink sheet to a top position of printing paper successively in order to allow printing with 2nd and 3rd color ink. Further, a belt-like positioning mark is provided by the use of one or three among three colors of ink for printing, at the top position of three color patches on the ink sheet for forming one image (i.e., at an intermediate position between 3rd and 1st color patches), while the thermal transfer printer includes color discriminating means for reading the belt-like positioning mark, and sensor means for measuring a width of the belt-like positioning mark based on both an output signal from the above color discriminating means and a transport length of the ink sheet measured by measuring means, and for discriminating between the printing ink areas and the mark area to thereby sense the positioning mark.

Since the above color discriminating means allows the thermal transfer printer to sense both the color change points and determine the end of operation for positioning a top position of the ink sheet, it is possible to initialize a set of color patches on the ink sheet by the use of the same hardware mechanism and the same operation algorithm, even in case of employing any of two types of ink sheets. Further, provision of the above transport means and the above transport length measuring means eliminates the need for discriminating 2nd and 3rd colors on the ink sheet individually and positioning a top position for each of the color patches separately. Thus, a set of color patches of the ink sheet coated with three colors can be initialized using only the above color discriminating means which is adapted to position 1st color on the ink sheet. In case where the belt-like positioning mark is provided at a top position of the ink sheet using three colors of ink for printing, the above color discriminating means reads the color(s) on the ink sheet and the above transport length measuring means measures a width of the belt-like color area(s) based on the measured transport length(s), so that the positioning mark comprising the belt-like color areas can be discriminated to initialize a set of color patches.

BRIEF DESCRIPTION OF THE DRAWINGS

FIGS. 10*a*–10*c* are explanatory views showing one example of circuit configuration adapted to correct a deviation of printing positions on the ink sheet in case of three color printing;

FIG. 20 is a plan view showing one example of the ink sheet in which a positioning mark is made up with three colors of ink for printing;

FIG. 21 is a block diagram showing circuit configuration for reading the positioning mark on the ink sheet made up with three colors of ink for printing;

DETAILED DESCRIPTION OF THE PREFERRED EMBODIMENTS

Preferred embodiments of a thermal transfer printer and an ink sheet cassette according to the present invention will be described hereinafter.

Figure 1A:
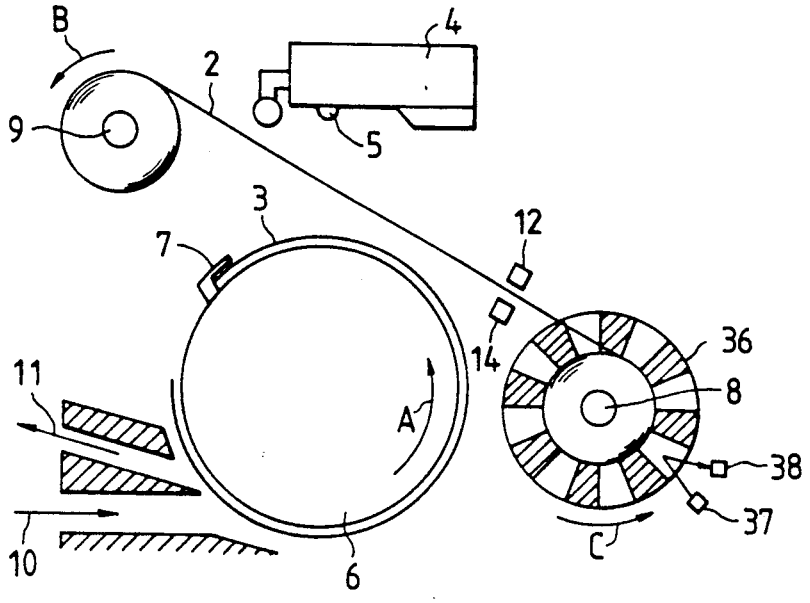
FIGS. 1*a* and 1*b* are side views showing one embodiment of a thermal transfer printer according to the present invention.
Figure 1B:
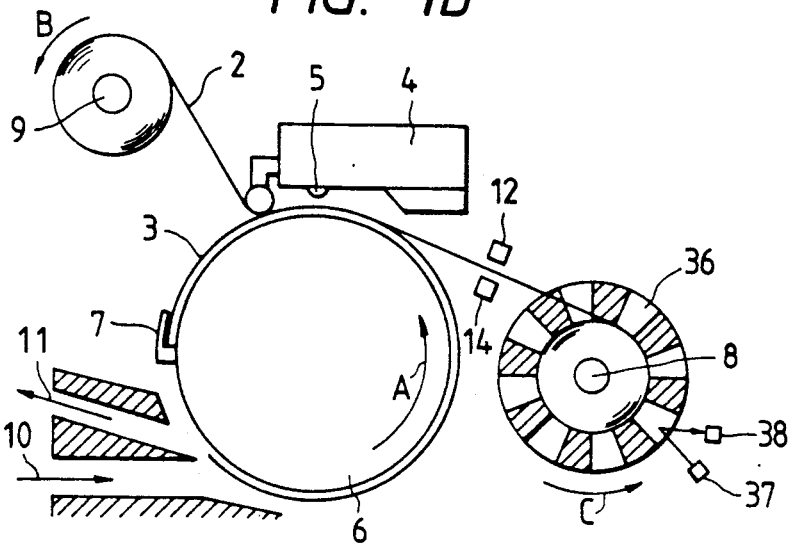

FIGS. 1*a* and 1*b* are side views showing construction and operation of a thermal transfer printer according to the present invention. Specifically, FIG. 1(*a*) is an explanatory view showing the initializing step of a mechanism prior to printing, and FIG. 1(*b*) is an explanatory view showing the mechanism during printing operation. Printing is performed by laying an ink sheet 2 made of tape-like film or paper over one piece of printing paper 3 around a drum 6, and heating the ink sheet 2 and the printing paper 3 by means of a heating element 5 provided on a thermal head 4, so that ink coated on the ink sheet 2 is thermal-transferred to the printing paper 3 for recording. Note that the ink sheet 2 for each picture consists of plural areas of different colors (three or four) arrayed in series.

Operation of the thermal transfer printer 1 will be described below. In FIG. 1(*a*), the printing paper 3 is inserted through a paper feed path 10 and is tightly held at its leading end to a chuck 7 provided on the drum 6. Then, the drum 6 is rotated in the direction of arrow A in the figure, so that the printing start position near the leading end of the printing paper 3 is moved to a position opposite to the heating element 5 provided on the thermal head 4. The surface of the ink sheet 2 coming into contact with the printing paper 3 has coated thereon serial patches of thermal transfer ink each in size corresponding to one picture on the printing paper 3 for three or four colors in cyclic pattern. Then, a take-up spool 9 is rotated in the direction of arrow B in the figure for feeding the tape-like ink sheet 2 to position an area of the ink sheet 2 coated with 1st color ink (a portion of the tape-like ink sheet 2). The position of 1st color ink patch on the ink sheet 2 is sensed based on color judgment using a pair of a light emitting diode (LED) 12 and an optical sensor 14. The method of positioning the ink sheet 2 with high accuracy will be described later. As the take-up spool 9 continues to rotate in the direction of arrow B, the leading end of 1st color ink patch on the ink sheet 2, which has been sensed by the pair of the LED 12 and the optical sensor 14, is now moved to a position opposite to the heating element 5 of the thermal head 4 in a like manner to the printing paper 3. The thermal head 4 is then lowered as shown in FIG. 1*b*. Thus, the thermal head 4 presses the printing paper 3 and the ink sheet 2 lying over the former together against the drum 6. In this condition, the heating element 5 is energized to produce heat. As a result, thermal transfer ink coated on the ink sheet 2 is transferred to the printing paper 3 in accordance with temperature distribution of the heating element 5. The heating element 6 comprises small resistors of 250 $\mu m \times 140\ \mu m$ in each size and corresponding to 512 dots arrayed in the axial direction of the drum 6. The periods of time energizing respective resistors of the heating element 5 can be changed independently from the another. Therefore, the respective resistors of the heating element 5 produce heat in an independent manner. Being exposed to heat produced by the respective resistors of the heating element 5, ink on the ink sheet 2 melts or sublimates an amount of ink dependent on the heat. This causes the ink on the ink sheet 2 to be transferred to the printing paper 3. By controlling the periods of time energizing the respective resistors of the heating element 5, 512 pixels are recorded on the printing paper 3 with corresponding thin and deep tints.

After 512 pixels per line have been recorded on the printing paper 3 through the foregoing process, the drum 6 is rotated by one step in the direction of arrow A. Then, a next one line is printed. By repeating 640 times the above operation, an image of one 1st color picture comprising 640×512 pixels is recorded on the printing paper 3 with thin and deep tints. Upon printing of one picture being completed, the thermal head 4 is raised to return to its original position, as shown in FIG. 1*a*, out of interference with the chuck 7 provided on the drum 6. The drum 6 is rotated to further advance in the direction of arrow A. And the printing start position near the leading end of the printing paper 3 is moved again to a position opposite to the heating element 5 of the thermal head 4. Then, a take-up spool 9 is rotated in the direction of arrow B to position a 2nd color portion of the ink sheet 2 (2nd color patch on the ink sheet 2 in an area corresponding to one picture). At this time, the 2nd color patch on the tape-like ink sheet 2 is positioned by feeding a predetermined length of the ink sheet 2 from a supply spool 8. To this end, rotation of the supply spool 8 is measured and the feed length of the ink sheet 2 is determined based on the measured result More specifically, in order to measure the rotation of the supply spool 8, a clock plate 36 having a white and black pattern formed on its surface is coaxially fitted over the supply spool 8. Rotation of the clock plate 36 is measured by utilizing the white and black pattern on the clock plate 36. To put it in detail, a clock LED 37 illuminates the white and black pattern on the clock plate 36, and the reflected or transmitted light from or through the white and black pattern is detected by a clock sensor 38. An output signal from the clock sensor 38 is varied upon rotation of the white and black pattern. Accordingly, it is possible to read the rotation of the supply spool 8 using the output signal from the clock sensor 38. Thus, the feed length of the ink sheet 2 is determined based on the number of patches of the white and black patterns on the clock plate 36 detected by the clock sensor 38. At this time, however, if the ink sheet 2 is fed using the same detected number of patches of the white and black patterns on the clock plate 36 at all times, the feed length of the ink sheet 2 would become different due to changes in diameter of the ink sheet 2 on supply spool 8. To overcome this, the following two correction methods can be applied: (1) during the printing operation in FIG. 1*b*, the rotation of the supply spool 8 and the feed length of the ink sheet 2 are measured based on the number of printed lines to determine the diameter of the ink sheet 2 on the supply spool 8 for modification of the feed length thereof; and (2) a pattern formed on the ink sheet 2 is employed to correct changes in the feed length of the ink sheet 2 (this method will be explained later).

Next, after positioning of 2nd color patch on the ink sheet 2, the thermal transfer printer is brought again into a condition as shown in FIG. 1*b* and one picture of 2nd color ink is printed. Further, printing of a picture of 3rd color ink is also carried out in a like manner. After that, the drum 6 is rotated in the direction opposite to arrow A. As a result, the printing paper 2 is ejected to the outside of the thermal transfer printer through a paper eject path 11. In this way, by printing the respective pictures of 1st to 3rd colors on one piece of printing paper, one color image is formed on the printing paper. At this time, the respective pictures of different colors have separate patterns from each other.

In the FIGS. 1*a* and 1*b*, the color of ink has been sensed with the transmitted light using the pair of the LED 12 and the optical sensor 14 provided in opposite relation with the ink sheet 2 lying therebetween. But, even in case that an LED and a sensor made up into one block are placed on one side of the ink sheet and a reflector plate is set on the other side for sensing the reflected light, the similar effect can be obtained as well.

Figure 2:
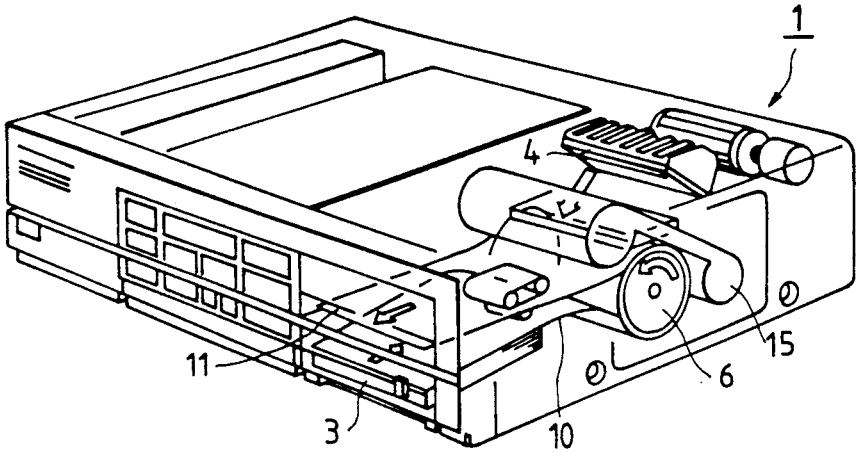
FIG. 2 is a perspective view showing one example of construction of the thermal transfer printer.

FIG. 2 is a perspective view showing entire construction of the thermal transfer printer 1 according to the present invention. The supply spool 8 and the take-up spool 9 shown in FIGS. 1*a* and 1*b* are mounted in an ink sheet cassette 15. Both the spools 8, 9 can be attached to the thermal transfer printer 1 simultaneously at the time the user inserts the ink sheet cassette 15 according to the present invention into the thermal transfer printer 1.

Figure 3A:
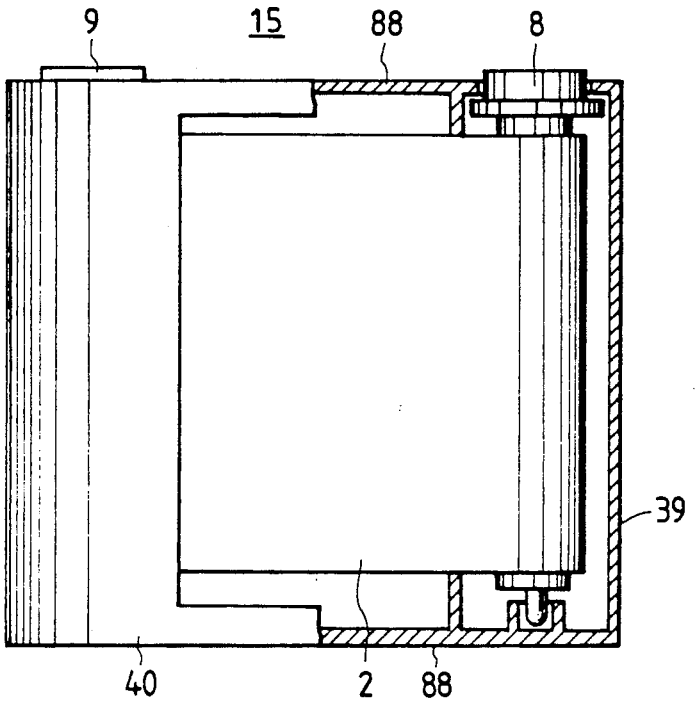
FIGS. 3*a*–3*c* are sectional views showing one example of construction of an ink sheet cassette according to the present invention.
Figure 3B:
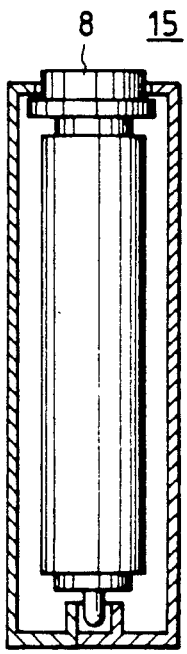
Figure 3C:
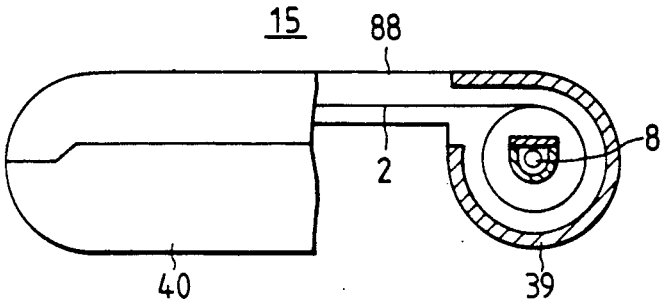

FIGS. 3*a*–3*c* are partly sectional views showing one example of the ink sheet cassette 15 according to the present invention. Specifically, FIG. 3*a* is a side view, FIG. 3*b* is a right-hand side view as obtained when seeing FIG. 3*a* from the right side, and FIG. 3*c* is a bottom view. The supply spool 8 is mounted in a supply spool covering portion 39 and the take-up spool 9 is mounted in a take-up spool covering portion 40, respectively. The supply spool covering portion 39 and the take-up spool covering portion 40 are interconnected by a connecting portion 88 such that both the spool covering portions 39, 40 are formed into an integral structure. The ink sheet cassette 15 is loaded into the thermal transfer printer 1 as shown in FIG. 2. Therefore, the supply spool 8 and the take-up spool 9 are simultaneously attached to the thermal transfer printer 1.

Figure 15B:
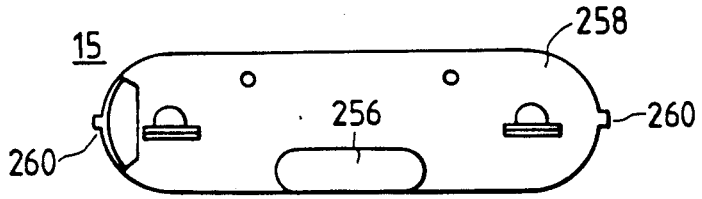
FIGS. 15*a*–15*d* are views showing one example of construction of an ink sheet cassette used for printing.
Figure 15D:
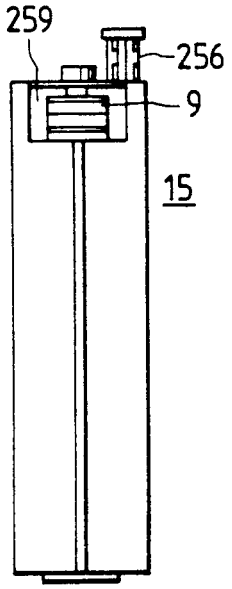
Figure 15A:
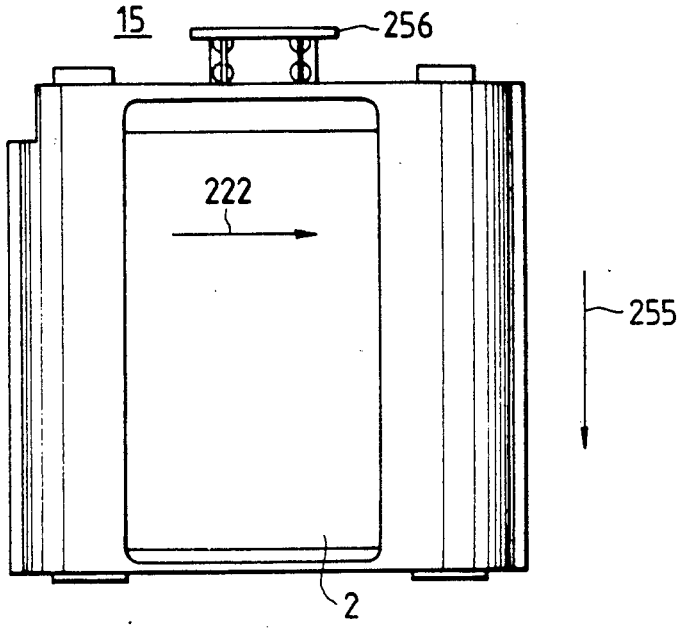
Figure 15C:
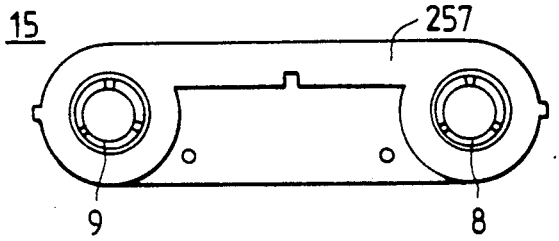

FIGS. 15*a*–15*d* are views showing, in more detail, the ink sheet cassette 15 illustrated in FIGS. 3*a*–3*c*. Specifically, FIG. 15*a* is a front view, FIG. 15*b* is a plan view, FIG. 15*c* is a bottom view, and FIG. 15*d* is a left-hand side view as obtained when seeing FIG. 15*a* from the left side. In the configuration of the ink sheet cassette 15 shown in FIGS. 15*a*–15*d*, a handle 256 is provided on an outer connecting portion 258 on the outer side with respect to the cassette inserting direction 255. The outer connecting portion 258 of broad width for holding the take-up spool 9 and the supply spool 8 is provided at the end of the ink sheet cassette 15 on the outer side in the cassette inserting direction 255. Likewise, an inner connecting portion 257 of narrow width is provided at the end of the ink sheet cassette 15 on the inner side with respect to the cassette inserting direction 255. At both side ends of the ink sheet cassette 15, there are also respectively provided ribs 260 for guiding the ink sheet cassette 15 into the thermal transfer printer 1 when the cassette is inserted. The ink sheet cassette 15 is further formed in its portion near the take-up spool 9 with a window 259 through which the user can observe the ink sheet 2 and the take-up spool 9.

According to this embodiment, since an entrance of the thermal transfer printer 1 for insertion of the cassette is covered by the outer connecting portion 258 of broad width to prevent exterior light from entering the inside of the thermal transfer printer 1, color discriminating means (described later) is kept from malfunctioning due to exterior light. Accordingly, the color discriminating means can effect accurate color discrimination.

Figure 4A:
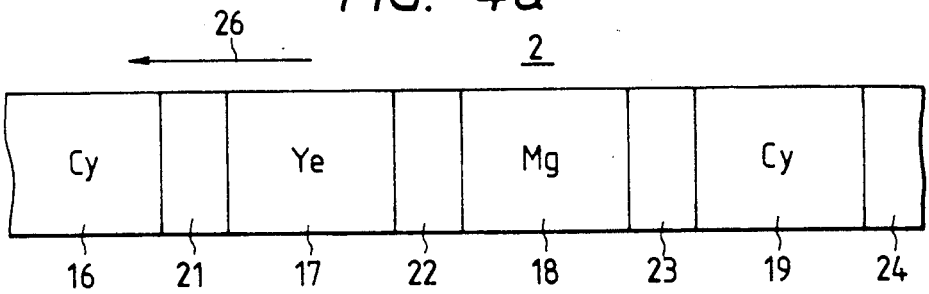
FIGS. 4*a* and 4*b* are plan views each showing one example of the coated pattern of an ink sheet accommodated in the ink sheet cassette of the present invention.

FIGS. 4*a* is a plan view showing one embodiment of the ink coated pattern of an ink sheet 2 accommodated in the ink sheet cassette of the present invention. In the embodiment of FIG. 4*a*, the ink coated pattern on the ink sheet 2 is made up with only three colors of ink (i.e., Ye, Mg and Cy) to be used for printing. Then, this embodiment has the coated color sequence of Ye 17, Mg 18 and Cy 19, and these three colors are printed on the printing paper 3 in this order. The three colors of ink are coated on the ink sheet 2 such that clear portions 21, 22, 23, 24 are placed between every adjacent color ink patches, and each color ink patch has the size larger than that of a printed area on the printing paper 3 (not shown). The direction of advancement of the ink sheet 2 in the thermal transfer printer 1 is indicated by arrow 26 in the figure. While the coated color sequence is given by the order of Ye 17, Mg 18 and Cy 19 in this case, it is not determined by the ink sheet 2 alone to first print which color ink. Accordingly, the thermal transfer printer 1 has to sense one of the colors on the ink sheet 2 to be first printed. Unlike the embodiment shown in FIG. 4*b*, however, the ink sheet 2 of this embodiment requires not to be manufactured by printing four colors, inclusive of black color. Printing of only three colors can make it possible to manufacture the ink sheet 2 at the lower cost.

Figure 4B:
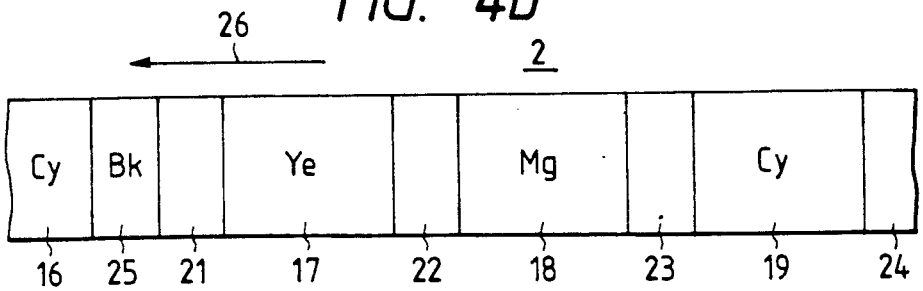

FIG. 4*b* is a plan view showing another embodiment in which the top position for printing is indicated using a patch of black ink 25. The direction of advancement of the ink sheet 2 in the thermal transfer printer 1 is indicated by arrow 26 in the figure. The coated pattern comprising three patches of three color ink 17, 18, 19 and clear portions 21, 22, 23, 24 is the same as that of FIG. 4*a*. In this embodiment, the top position is indicated by the patch of black ink 25 formed ahead of the patch of Ye ink 17 at the leading end of the ink sheet 2 in an area corresponding to one picture. The coated pattern of FIG. 4*b* is featured in that there present no clear portion between the patch of black ink 25 and the patch of Cy ink 16. The thermal transfer printer 1 of the present invention has a feature to position the top positions of both the ink sheets 2 as shown in FIGS. 4*a* and 4*b* by the use of the same hardware construction and the same reading algorithm. Incidentally, the method of sensing the top position will be described below.

Figure 5A:
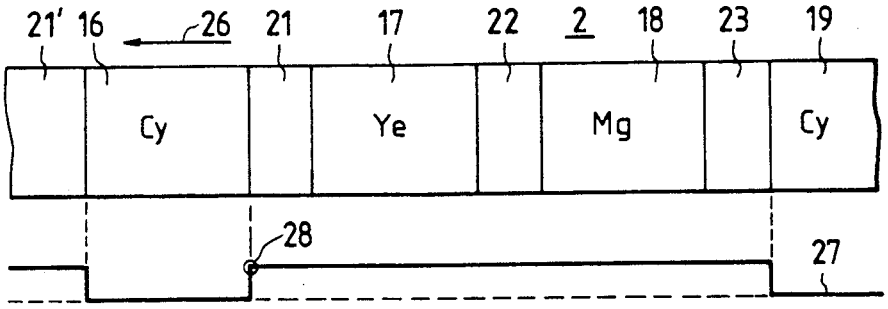
FIGS. 5*a*–5*c* and 6*a*–6*c* are explanatory views showing examples of output signals issued from a sensor when colors on the ink sheet are read by the sensor.
Figure 5B:
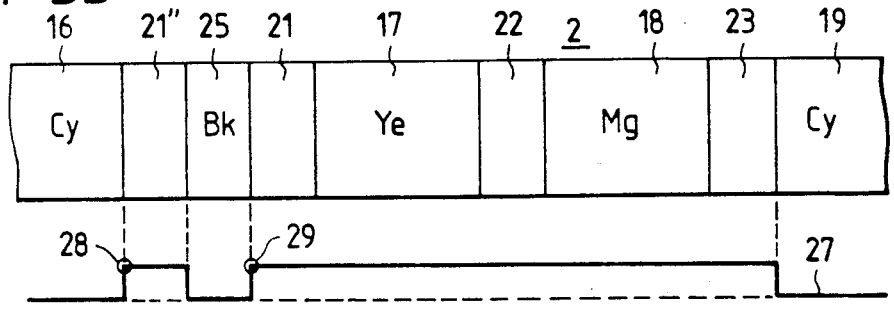
Figure 5C:
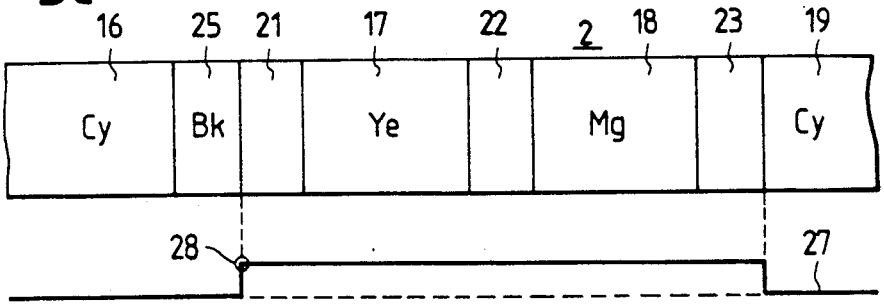

FIGS. 5*a*-5*c* are explanatory views showing examples of methods for sensing the top position of the ink sheet 2 shown in FIG. 4*a* or 4*b* in accordance with the present invention. FIG. 5*a* shows an example in which the ink sheet 2 is made up with only three colors similarly to that of FIG. 4*a*. Thus, the coated color sequence is given by the order of Ye 17, Mg 18 and Cy 19, and the color at the top for printing is the Ye 17. In this embodiment, the LED 12 mounted in the thermal transfer printer 1 comprises a light emitting diode which emits red light, and the optical sensor 14 comprises a visible light sensor. Among the patches of Ye, Mg and Cy ink and clear portions, an output signal of the optical sensor 14 assumes a low level (L) for the patches of Cy ink 16, 19 alone and a high level (H) for the patches of other colors 17, 18 and clear portions 21-23. Therefore, to detect the position of the patch of Ye color 17 at the top, a rising edge 28 of the output signal 27 from the optical sensor 14 is sensed. FIG. 5*b* is a view showing another example of the ink sheet 2 in which a patch of black ink 25 is additionally printed for indicating the top of the ink sheet 2. When the top of this type ink sheet 2 is sensed using the same LED 12 emitting red light and the optical sensor 14 for visible light as those in the case of FIG. 5*a*, there appear sensed rising edges at two points 28 and 29 which potentially indicate the top of the ink sheet 2. If the top sensing operation is started from a position corresponding to Cy 16, the first sensed rising edge 28 would be regarded as to indicate the color at the top. This would cause the position of the top color to be judged in advance of that in case of FIG. 5*a* by a total width of a clear portion 1" and the patch of black color 25. However, where each patch of the color ink on the ink sheet 2 has a much greater length than that of an printed area of the printing paper 3 and hence has a sufficient allowance, there will not occur any problem even if the sensed top position is shifted by a total width of the clear portion 21" and the patch of black color 25. FIG. 5*c* is a view showing still another example of the ink sheet 2 in which there is no clear portion between the patches of Cy 16 and black 25. In this example, the output signal 27 from the optical sensor 14 as obtained when using the above pair of the LED 12 emitting red light and the optical sensor 14 for visible light has the sensed rising edge 28 at only one point. Based on the sensed rising edge 28, the top color of the ink sheet 2 can be positioned in a like manner to FIG. 5*a*. By utilizing a combination of the pattern of the ink sheet 2, the pair of the LED 12 emitting red light and the optical sensor 14 for visible light, and detection of the sensed rising edge of the output signal 27 from the optical sensor 14 as mentioned above, the top color of the ink sheet 2 can be sensed and positioned by the use of the same mechanism and the same positioning algorithm for the thermal transfer printer 1 irrespective of whether the presence or absence of the positioning black mark 25 on the ink sheet 2.

In the above description of FIGS. 5*a*-5*c*, the pair of the LED 12 and the optical sensor 14 has been constituted by an LED emitting red light and a visible light sensor. But, this pair may be of any suitable pair of an LED emitting different color of light and other type of optical sensor so long as it can output a similar signal. For example, in case of sensing light in a range of longer wavelength (e.g., approximately 800 nm) using an optical sensor for near-infrared light, the top color can be sensed by the near-infrared light sensor by setting it to issue the output level 27 of an L level for Cy, black and of an H level for others among the patches of four colors Cy, Mg, Ye, black and the clear portions.

Further, the foregoing embodiment has been explained as using the thermal transfer printer 1 and the ink sheet 2 adapted to print an image by transferring three colors of ink in the sequence of Ye, Mg, Cy. In this respect, however, the similar effect can be obtained with other color sequence. Stated otherwise, the top position can be sensed by employing any sensor which produces similar changes in the signal level upon transitions from 3rd color to 1st color and from black to 1st color. Thus, the sequence of color ink coated on the ink sheet 2 is not essential to the present invention.

Figure 6A:
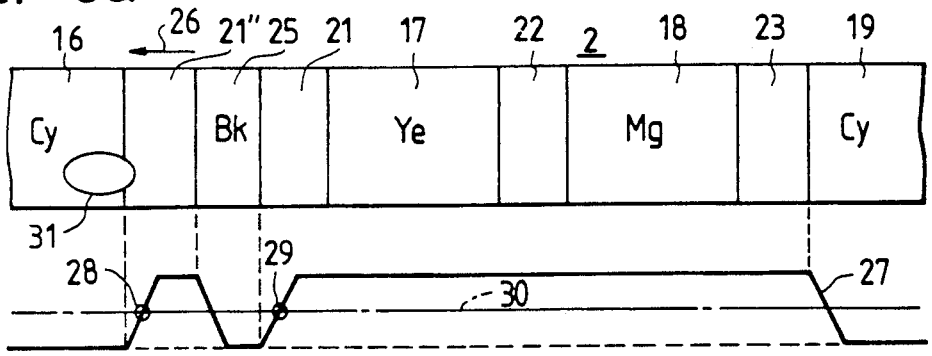
Figure 6B:
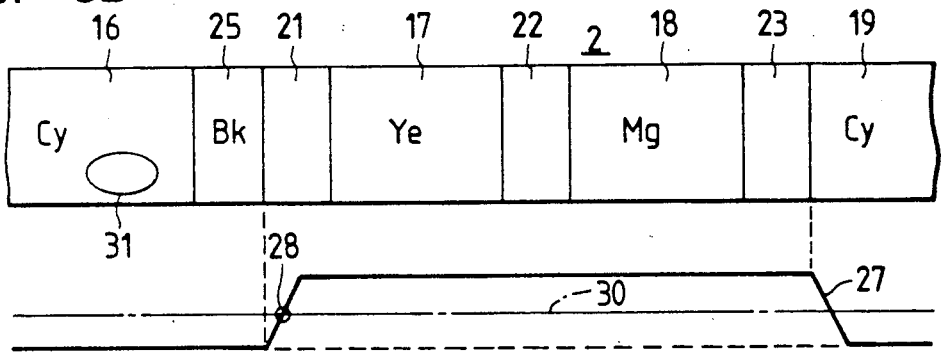
Figure 6C:
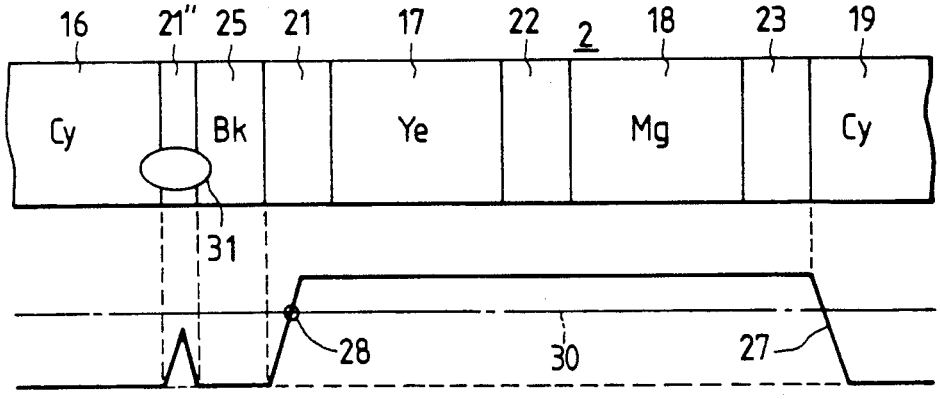

FIGS. 6*a*-6*c* are views for explaining the relationship between the size of a sensor opening and the width of a clear portion on the ink sheet 2, in accordance with a second embodiment of the present invention. A range viewed by the optical sensor 14 for sensing the color on the ink sheet 2 is usually given by a sensor opening 31 with an area of certain size. Accordingly, the sensed rising edge of waveform of the output signal 27 from the optical sensor 14 corresponding to transition from the patch of Cy 16 or black 25 to the clear portion 21 will not take place momentarily or not appear vertically. The sensed rising edge is inclined at a particular slope as the sensor opening 31 goes across the border of the different color patches. So, determination as to whether the output signal 27 assumes a high level (H) or a low level (L) is performed by setting a threshold 30 at predetermined voltage. Thus, the level of the output signal 27 is judged as H or L using a level discriminating circuit such as a converter (not shown) which discriminates as to whether the output signal level is higher or lower than the threshold 30.

While the ink sheet 2 and the output signals 27 from the sensor 14 shown in FIGS. 6*a* and 6*b* are similar to those shown in FIGS. 5*b* and 5*c*, respectively, FIGS. 6*a* and 6*b* include each the threshold 30 to illustrate level discrimination of the output signal 27 from the optical sensor in more detail. Explanation of level pattern of the output signals 27 from the optical sensors and of how to determine the sensed rising edge(s) 28, 29 will be omitted because they are identical to those of FIGS. 5*b* and 5*c*, respectively. FIG. 6*c* is a view showing an example in which the width of the clear portion 21" lying between the patches of Cy 16 and black 25 is made narrower than that of at least the sensor opening 31. As the sensor opening 31 runs over the ink sheet 2 and goes across from the patch of Cy 16 and the clear portion 21", the level of the output signal 27 from the optical sensor 14 is raised gradually. However, before the level of the output signal 27 from the optical sensor 14 has reached the threshold 30, the sensor opening 31 reaches the patch of black 25 from the clear portion 21". As a result, the level of the output signal 27 from the optical sensor 14 then starts to lower as the sensor opening 31 continues to run over the ink sheet 2. Therefore, in case of forming the clear portion 21" of narrow width between the patches of Cy 16 and black 25, the top position of the ink sheet 2 can be prevented from being recognized erroneously because the output signal 27 will not reach the threshold 30 and its level will not be regarded as H even with the presence of the clear portion 21".

When the ink sheet 2 shown in FIG. 6*b* is fabricated in the process of manufacturing the ink sheet 2, it is difficult to ensure high accuracy necessary to form the patches of Cy 16 and black 25 without providing no gap at the border therebetween. Also, in case that there would cause a problem of staining a printing plate when two different colors of ink 16, 25 are printed contiguous to each other, the clear portion 21" may be formed under a condition of within a predetermined width as mentioned above.

Figure 7A:
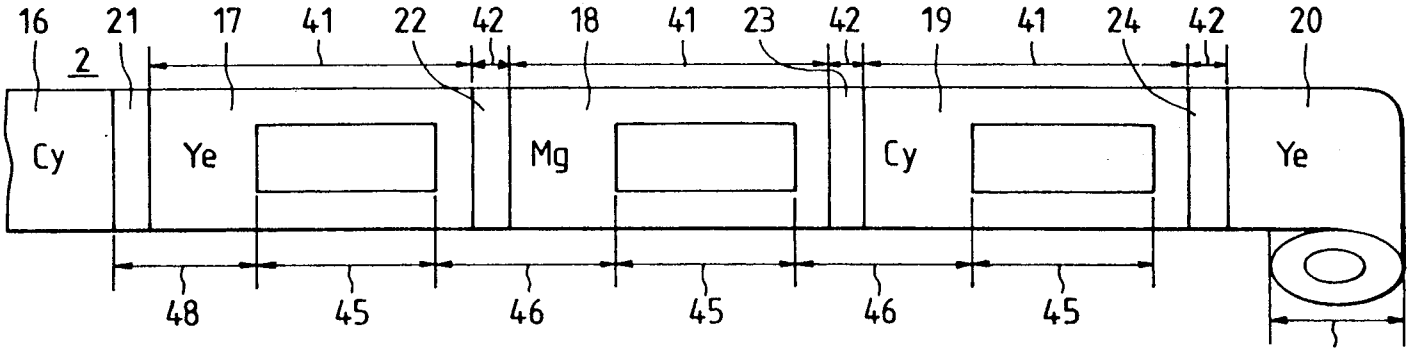
FIGS. 7*a* and 7*b* are explanatory views showing printing positions on the ink sheet when 1st, 2nd and 3rd color patches of the ink sheet are printed.
Figure 7B:
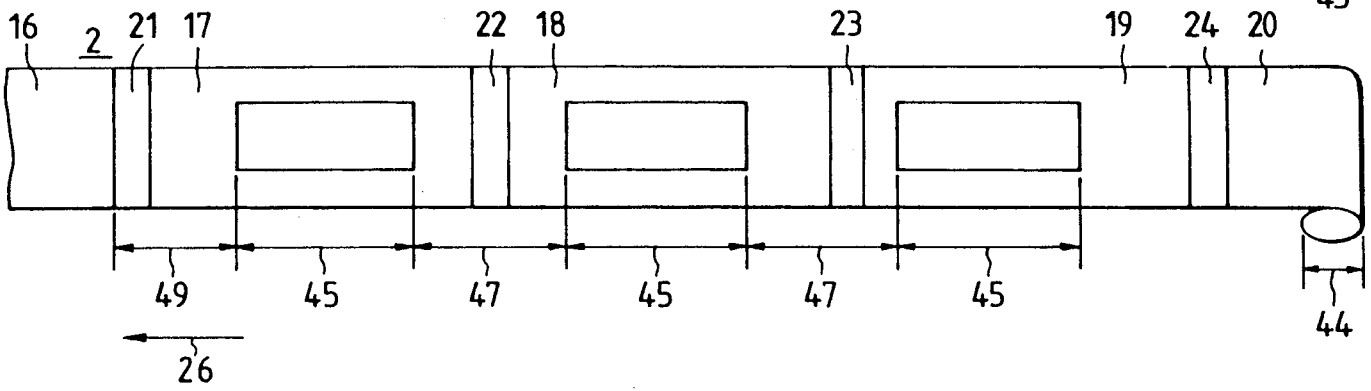

FIGS. 7*a* and 7*b* are views showing changes in printing position of the ink areas on the ink sheet 2. When the feed length of the ink sheet 2 is controlled based on the number of revolutions of the supply spool 8 in order to position the 2nd and 3rd color ink on the ink sheet 2, the ink areas used for printing will be changed in position over time. For example, the feed length of the ink sheet 2 as advanced during one revolution of the supply spool 8 is increased with the ink sheet 2 on the supply spool 8 having the larger diameter. Therefore, the ink area on the ink sheet 2 used for printing approaches the rear edge near the supply spool 8 as the diameter of the ink sheet 2 on the supply spool 8 is larger. FIG. 7*a* shows a condition where the ink sheet 2 is still sufficiently wound around the supply spool 8 and the ink-sheet diameter 43 on the supply spool is large. The point used for sensing the top color on the ink sheet 2 is given by the border between the patch of Cy 16 and the clear portion 21, which border is sensed by the optical sensor 14 shown in FIGS. 1*a* and 1*b*. Then, the ink sheet 2 is transported by a positioning transport length 48 to thereby position the ink sheet 2 for printing. While printing, the ink sheet 2 is transported by a printing length 45. Subsequently, in order to 2nd ink Mg 18, the ink sheet 2 is transported by a inter-printing transport length 46 so that the ink sheet 2 is positioned for 2nd color ink. Then, a picture of 2nd color is printed in a like manner to the case of 1st color. Printing of a picture of 3rd ink Cy 19 is also carried out for the printing length 45 after feeding the ink sheet 2 by the inter-printing transport length 46. On this occasion, the position of the successive printing lengths 45 for three colors is offset to gradually approach the rear edge of an ink coated length 41 on the ink sheet 2.

FIG. 7(*b*) is a view showing a condition that the ink sheet 2 is scarcely left on the supply spool 8. As illustrated, the ink-sheet diameter 44 on the supply spool is small. As with the case of FIG. 7*a*, after sensing the top color on the ink sheet 2, the thermal transfer printer transports the ink sheet 2 by a positioning transport length 49. This positioning transport length is controlled based on rotation of the supply spool 8. Considering now the case that the ink sheet 2 has been transported by a length corresponding to one revolution of the supply spool 8, the positioning transport length 49 in FIG. 7*b* is smaller than the positioning transport length 48 in FIG. 7*a* because the ink-sheet diameter 44 on the supply spool in FIG. 7*b* has a smaller circumferential length than the ink-sheet diameter 43 on the supply spool in FIG. 7*a*. Although the subsequent printing length 45 is equal in both FIGS. 7*a* and 7*b*, a inter-printing transport length 47 in FIG. 7*b* is also smaller than the inter-printing transport length 46. In contrast with the case of FIG. 7*a*, therefore, the position of successive printing lengths 45 for three colors is offset to gradually approach the front edge (the side near the take-up spool 9) of an ink coated length 41 on the ink sheet 2 whenever printing is made for each color ink. Here, by setting the ink coated length 41 so long that the printing length 45 will not exceed beyond either edge of the ink coated length 41 even if the printing length 45 approaches its frontmost or rearmost position, it becomes possible to control the positioning transport length 48, 49 and the inter-printing transport length 46, 47 based on predetermined rotation of the supply spool 8.

Figure 8A:
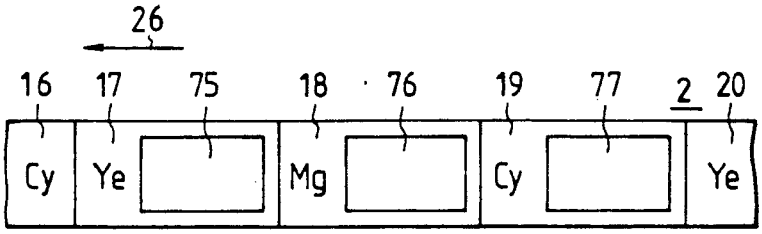
FIGS. 8*a*–8*e* are explanatory views showing an example of correcting a deviation of printing positions on the ink sheet in case of three color printing.
Figure 8B:
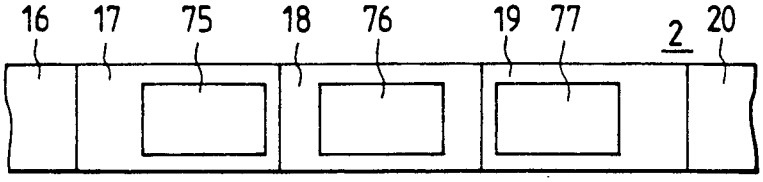
Figure 8C:
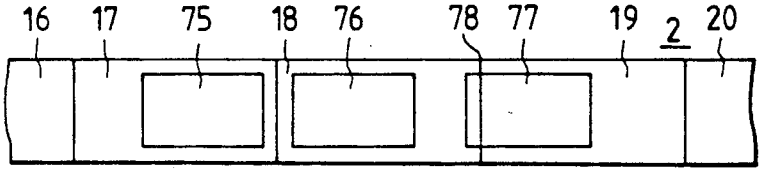

Further, FIGS. 8*a*–8*e* are views showing the ink areas used for printing which are changed in position dependent on the ink-sheet diameter on the supply spool 8 as with the cases of FIGS. 7*a* and 7*b*. Designated at 75, 76, 77 are printing areas of Ye, Mg, Cy, respectively. To put it in more detail, FIG. 8*a* is a view showing the positions of the printing areas on the ink sheet 2 in a condition that the ink sheet 2 is sufficiently wound around the supply spool 8. FIG. 8*b* shows the position shift of the printing areas on the ink sheet 2 in a condition that the ink-sheet diameter 44 on the supply spool has become small. In this condition, the printing area has been moved toward the front edge of the ink coated length on the ink sheet 2. According to this embodiment, however, the ink sheet 2 has not yet consumed completely in this condition and the ink-sheet diameter 44 on the supply spool will be further reduced. FIG. 8*c* is a view showing the position shift of the printing areas on the ink sheet 2 in such a condition that the ink sheet 2 has been further consumed. The printing area more approaches the front edge of the ink coated length on the ink sheet 2 and finally the Cy printing area 77 exceeds a border 78 between the patches of Mg 18 and Cy 19. If printing is performed in this condition, a part of the printing area to be totally printed with Cy ink 19 would be printed with Mg ink 18, thereby resulting in abnormal printing.

Figure 8D:
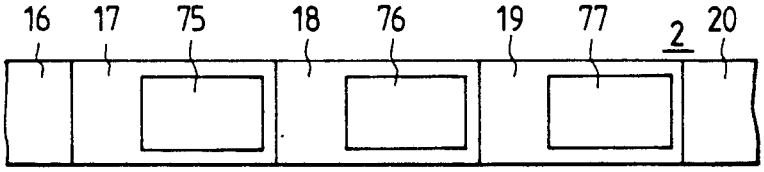
Figure 8E:
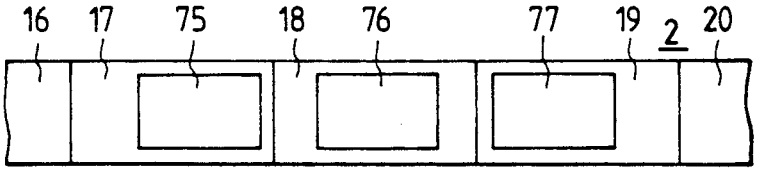

FIG. 8*d* is a view showing the positions of the printing areas on the ink sheet 2 in a condition resulted from solving the above problem in FIG. 8*c*. The essential of the solving method is, though described later in detail, in varying the inter-printing transport lengths 46, 47 in FIGS. 7*a* and 7*b* dependent on the ink-sheet diameter on the supply spool. In other words, it is so set that the inter-printing transport lengths 46, 47 are given by only one revolution of the supply spool 8 in a condition that the ink sheet 2 is sufficiently wound around the supply spool 8, while the inter-printing transport lengths 46, 47 are given by two revolutions of the supply spool 8 in a condition that the ink sheet 2 is wound around the supply spool 8 with the diameter less than a half the initial value. As a result, the inter-printing transport length of the ink sheet 2 can be held nearly constant to prevent the printing area from exceeding the border 78 between the ink coated patches as would be caused in FIG. 8*c*. Moreover, FIG. 8*e* is a view showing the position shift of the printing areas in a condition that the ink sheet 2 is scarcely left around the supply shaft 8. As shown, the printing areas are located within a range of each ink coated length on the ink sheet 2. The ink-sheet diameter on the supply spool can be determined by measuring an absolute transport length per clock of an output signal from the clock sensor 38 for detecting rotation of the supply spool 8. Note that the absolute transport length of the ink sheet 2 can be measured in the condition of FIG. 1*b*.

Although this embodiment has been described as changing the inter-printing transport length of the ink sheet 2 in two steps dependent on consumption of the ink sheet 2, the inter-printing transport length may be changed in any number of steps. As an alternative, it is also possible to measure an absolute transport length per clock of an output signal from the clock sensor 38 (described later), thereby constantly keeping the printing area nearly at the same position within the ink coated length on the ink sheet 2.

Figure 9A:
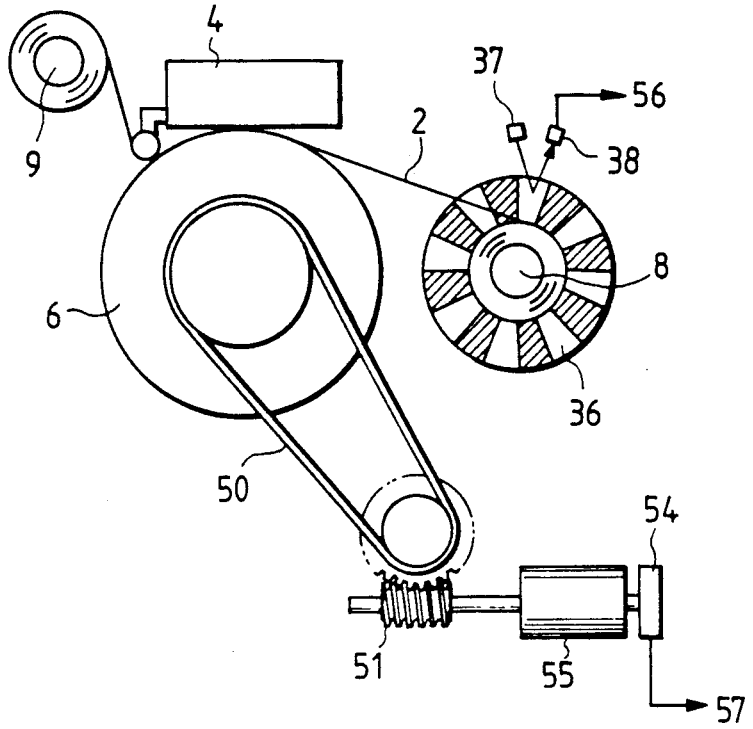
FIGS. 9*a* and 9*b* are explanatory views showing an example of construction of the thermal transfer printer for measuring an absolute transport length of the ink sheet, and one example of an output signal from the sensor for measuring the absolute transport length, respectively.
Figure 9B:
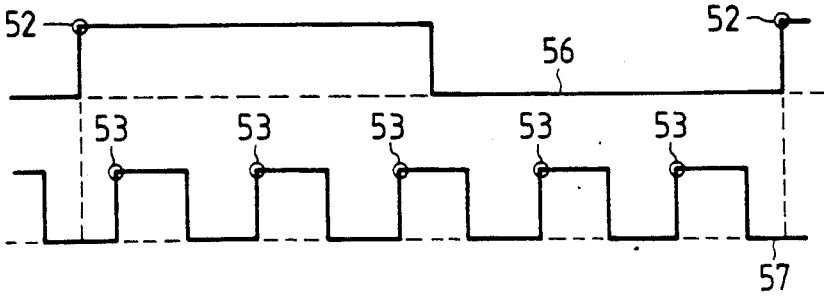

FIGS. 9*a* and 9*b* are views showing one example of the method of measuring an absolute transport length of the ink sheet 2 per clock of an output signal 56 from the clock sensor 38, in accordance with a third embodiment of the present invention. Specifically, FIG. 9*a* is a side view showing one example of a mechanism for driving the drum 6 in the thermal transfer printer 1. In FIG. 9*a*, the ink sheet 2 under printing is transported upon rotation of the drum 6. While printing, therefore, the absolute transport length of the ink sheet 2 can be measured by sensing the number of revolutions of the drum 6. One practical method of measuring the absolute transport length employs an FG generator 54 provided coaxially with a motor 55 for driving the drum 6. The FG generator 54 issues one pulse signal (FG signal) 57 per rotation of the motor 55. The ink-sheet diameter on the supply shaft is detected in cooperation with the clock signal 56 issued from the clock sensor 38. More specifically, the number of FG signals 57 is counted by a counter for each clock of the clock signal 56. When the counted value is higher than a predetermined value, the ink-sheet diameter on the supply shaft is found large. When it is lower than a predetermined value, the ink-sheet diameter on the supply shaft is found small. Torque of the motor 55 is transmitted to the drum 6 through a speed reducing gear 51 and a torque transmitting belt 50 at the constant speed reduction ratio. Here, by making rotation of the drum 6 for one line of printing in match with each cycle of the FG signal 57, the FG signal 57 can be used as a timing signal indicating start-up of printing of each line. Then, use of the FG signal 57 thus set makes it possible to measure the absolute transport length of the ink sheet 2 corresponding to one clock of the clock signal 56. Accordingly, there is no need of attaching any additional members to measure the absolute transport length of the ink sheet 2, with the consequence that the cost can be restrained as low as possible. FIG. 9*b* is a time chart showing the clock signal 56 and the FG signal 57 in corresponding relation. In FIG. 9*b*, the range of measuring the FG signal 57 is defined by an interval between two sensed rising edges 52 of the clock signal 56, during which interval there are five sensed rising edges 53 of the FG signal 57. It is thus found that the ink sheet 2 is transported by a length corresponding to five printing lines for each cycle of the clock signal 56. In this case, the phase relationship between the clock signal 56 and the FG signal 57 will cause an error of $\pm 1$ at maximum in the counted value of the FG signal 57. With such error taken into consideration, the inter-printing transport length in FIGS. 8*a*–8*c* is controlled.

Although this embodiment has been explained as sensing the rotation of the supply spool 8 to control the inter-printing transport length of the ink sheet, similar control may be performed by sensing the rotation of the take-up spool 9. In this case, an FG generator is used which is associated with a motor (not shown) for rotating the take-up spool 9 and adapted to control rotation of the motor.

FIGS. 10*a*–10*c* are views showing one example of changing the inter-printing transport length shown in FIGS. 8*a*–8*e* based on the number of FG signals for one cycle of the clock signal 56, in accordance with a fourth embodiment of the present invention. In FIG. 10*a*, assuming that the ink-sheet diameter 43 on the supply spool is in a range of from 15 mm to 30 mm and a rotation angle 79 of the clock plate 36 per clock is equal to $\frac{1}{8}$ turn, the transport length of the ink sheet 2 for one cycle of the clock signal 56 is given by a range from 5.89 mm to 11.78 mm. Also, let it be assumed that a length of the ink sheet 2 transported for one pulse of the FG signal 57 (that is, 1FG transport length 80) is equal to 190 $\mu$m, the transport length of the ink sheet 2 for one cycle of the clock signal 56 is given by a range from 31 to 62 in units of the counted value of the FG signal 57 (that is, FG number). FIG. 10*b* is a table in which the FG number is represented in binary notation.

While the FG number is proceeding from 31 to 62, the inter-printing transport length is assumed to be changed at the intermediate value of about 48 during that count range. As shown in FIG. 10*b*, the most significant bit (MSB) changes from 0 to 1 between 31 and 32, and the least significant bit (LSB) changes from 0 to 1 between 47 and 48. Therefore, logical AND of the 5th bit from LSB and the 6th bit (i.e., MSB) is taken, and if the result is equal to 1, the inter-printing transport length is changed to a longer one. This completes the algorithm for changing the inter-printing transport length without needing the complicated decision. FIG. 10*c* is a view showing the configuration of a hardware circuit adapted to carry out measurement of the FG number and the decision algorithm.

In FIG. 10*c*, a counter 81 receives a clock signal 56 to a reset input 84 through a delay circuit 82. Being reset by a delayed clock signal 56', the counter 81 starts counting the number of pulses of the FG signal 57. The counted value (FG number) of the counter 81 is output in the form of a 6-bit parallel signal. The logical product of the 5th bit and the 6th bit of the parallel output signal is taken through an AND gate 85, and the resulting signal is applied to a latch 88. The latch 86 senses a next rising edge of the clock signal 56 and then latches the output signal from the AND gate 85. The counter 81 is reset subsequent to latching operation of the latch 86, after a delay time set by the delay circuit 82 has elapsed. Thus, the FG number can accurately be extracted and processed within one cycle of the clock signal 56.

Note that the logical product of the 5th and the 6th bits of the output signal from the counter 81 may be taken by utilizing the software, such as a BIT-TEST command and the like, for a microcomputer 87 to control the entire system.

Figure 11A:
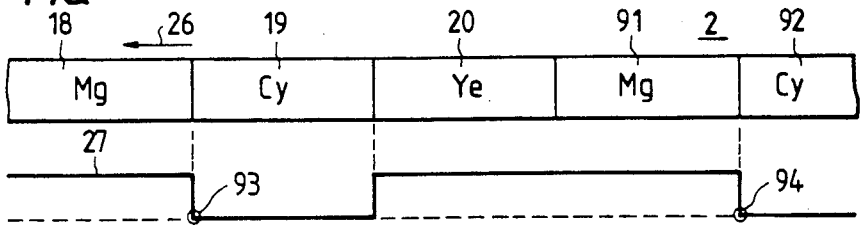
FIGS. 11*a* and 11*b* are explanatory views showing examples of the ink sheet and examples of an output signal from the sensor, when the color sequence of the ink sheet is changed.
Figure 11B:
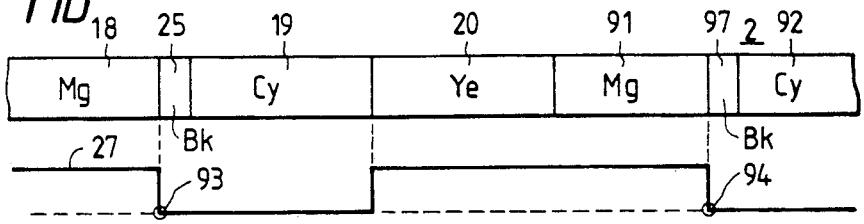

FIGS. 11*a* and 11*b* are views showing another example of sensing the top position of the ink sheet 2, in accordance with a fifth embodiment of the present invention. Specifically, FIGS. 11*a* and 11*b* show each an ink sheet 2 and an output signal 27 from the sensor. In FIG. 11*a*, the color sequence on the ink sheet 2 is given by the order of Cy 19, Ye 20, Mg 91 which is different from the foregoing one. The output signal 27 shown in FIG. 11*a* is resulted in case of employing the same LED 12 and optical sensor 14 as those shown in FIGS. 1*a* and 1*b*. The output signal 27 from the optical sensor 14 changes in its level from H to L at the border between Mg 18 and Cy 19 (or between the patches of 3rd and 1st color ink), i.e., at the top position of the ink sheet 2. By sensing such falling edge 93, 94, the top position can be detected even for the ink sheet 2 having the color sequence of Cy 19, Ye 20, Mg 91, as well. FIG. 11*b* is a view showing an example in which a black positioning mark 25 is added to the ink sheet 2 having the color sequence of Cy 19, Ye 20, Mg 91 as shown in FIG. 11*a*. In this example, a falling edge 93 of the output signal 27 from the optical sensor 14 appears at the border between the patches of Mg 18 and black 28. In other words, the sensed top position is different from that in case of FIG. 11*a* by a distance corresponding to the patch width of black 25. Even if the sensed top position is shifted by a distance corresponding to the patch width of black 25, there will occur no problem by setting the color pitch of the ink sheet 2 so that the printing areas will remain within each color region on the ink sheet 2, or by making the positioning control of 2nd and 3rd color regions on the ink sheet 2 as well. With the above expedient taken into account, the ink sheet 2 having the color sequence of Cy 19, Ye 20, Mg 91 can also be positioned by the use of the same mechanism and algorithm of the thermal transfer printer 1 irrespective of whether the presence or absence of the black positioning mark 25.

Figure 12A:
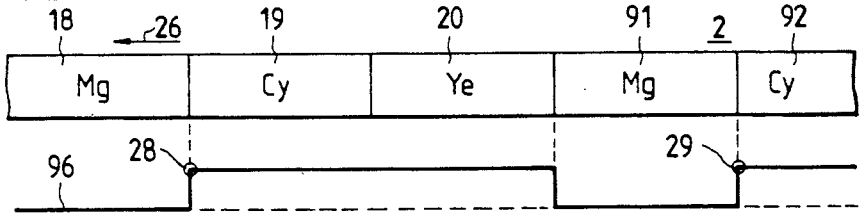
FIGS. 12*a* and 12*b* are explanatory views showing examples of the ink sheet and examples of an output signal from the sensor, when the color sequence of the ink sheet and color of a light source for the sensor are both changed.
Figure 12B:
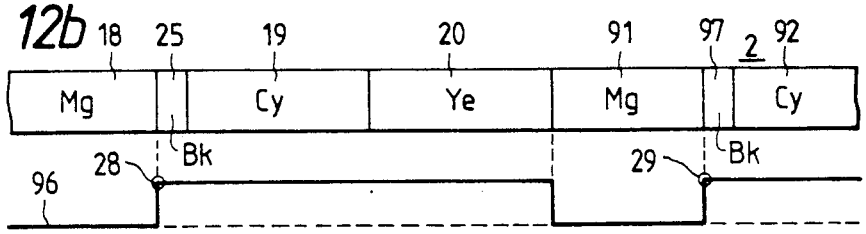

FIGS. 12*a* and 12*b* are views showing an example in which the top color on the ink sheet using another sensor 14' (not shown) for different color. The color sequence of the ink sheet is the same as that in examples of FIGS. 11*a* and 11*b*. In FIGS. 12*a* and 12*b*, a light source of green color (G) and an optical sensor (G sensor) are employed to judge the ink color on the ink sheet 2. An output signal 96 from the G sensor changes from a low level (L) to a high level (H) at the border between Mg 18 and Cy 19. Accordingly, sensing the rising edge 28, 29 makes it possible to position the top color on the ink sheet with the method explained in relation to FIGS. 5*a*–5*c*.

As illustrated in FIGS. 11*a*–12*b*, there are two types of techniques to be implemented by the mechanism and the reading algorithm for positioning the top color on the ink sheet 2 having any color sequence, i.e., two types of detection of rising and falling edges. In practice, the optimum technique is selected in view of the cost of the optical sensor 14, 14' and the scale of software used.

Figures 13A, 13B:
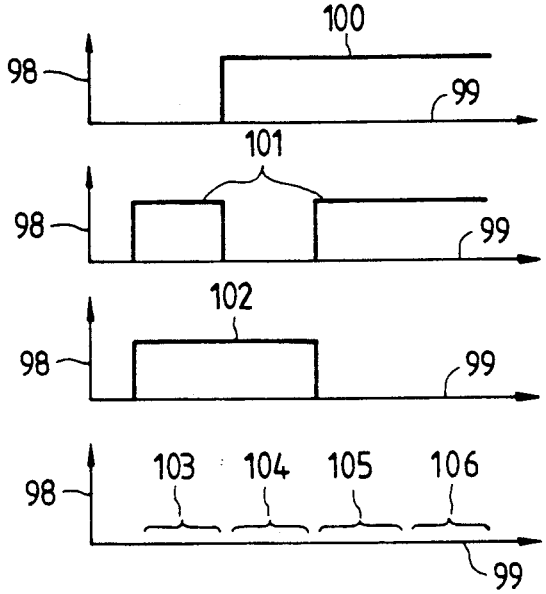
FIGS. 13*a* and 13*b* are explanatory views showing the relationship between wavelength and transparence for each of ink colors on the ink sheet, and examples of output signals issued from the sensors dependent on both the colors of light sources for the sensor and the colors on the ink sheet, respectively.

FIGS. 13*a* and 13*b* are views showing the relationship between types of the optical sensors 14, 14' and ink colors on the ink sheet 2. FIG. 13*a* is a characteristic view showing wavelength spectra of the colors detected by the sensors 14, 14' and the ink colors on the ink sheet 2, in which the X-axis represents wavelength 99 and the Y-axis represents transparence 98. When red light (R light) 105 is used for sensing the ink colors on the ink sheet 2, a yellow spectrum (Ye spectrum) 100 and a magenta spectrum (Mg spectrum) 105 transmit the R light 105 and hence the output signal from the optical sensor 14, 14' assumes a light level (H), while a cyan spectrum (Cy spectrum) 102 does not transmit the R light 105 and hence the output signal assumes a low level (L). As a result, the above-mentioned sensing of the positioning mark or the top color can be effected. In case of using infrared light (IR light) 106, spectra of the respective colors (Ye, Mg, Cy) on the ink sheet in the infrared range are equivalent to those in the range of R light 105 and, therefore, the similar positioning of the ink sheet can be effected using an infrared sensor in place of the optical sensor (R sensor) 14 for sensing red light. Incidentally, designated at 104, 103 in FIG. 13*a* are green light (G light) and blue light (B light), respectively. FIG. 13*b* is a table showing levels of output signals from the optical sensors 14, 14' for various combinations of types of ink colors 108 and types of optical sensors 107. In case of using the R sensor, for example, the output signal from the optical sensor 14 assumes a low level (L) for Cy and black colors of ink, and a high level (H) for other colors of ink. Thus, to sense the top color on the ink sheet 2, such an optical sensor which issues an output signal of different levels for 3rd and 1st colors of ink is selected.

Figure 14A:
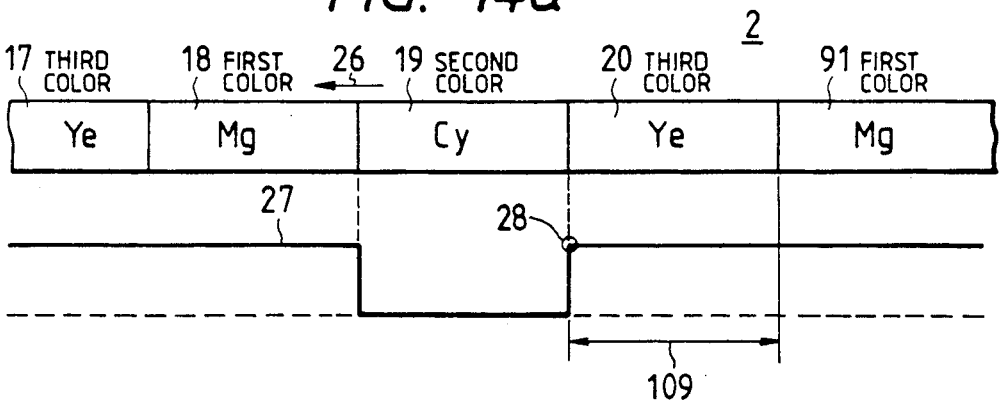
FIGS. 14*a* and 14*b* are explanatory views showing one example of the ink sheet adapted for positioning 1st color ink by rewinding the ink sheet, and one example of construction of the thermal transfer printer for this end, respectively.
Figure 14B:
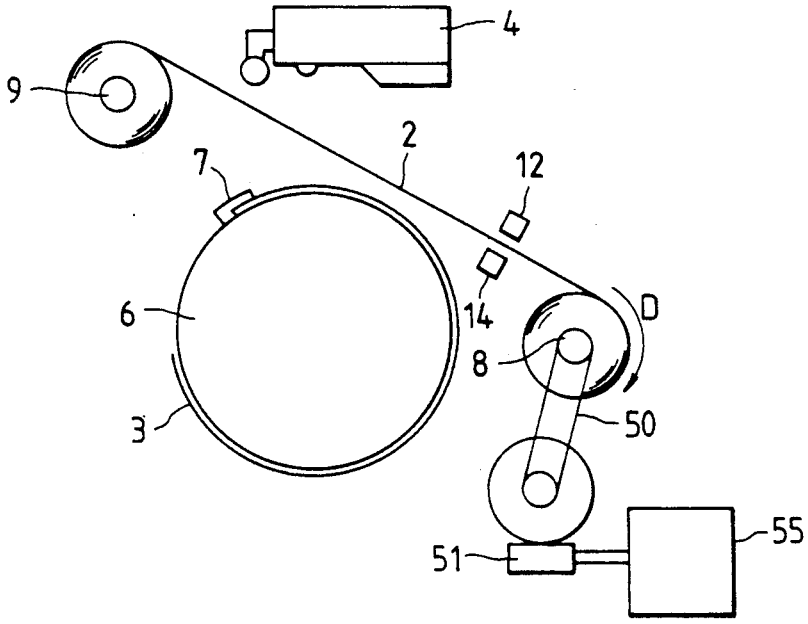

Next, FIGS. 14*a* and 14*b* are views showing one example of positioning 1st color ink on the ink sheet 2 having the different color sequence by the use of an infrared sensor, in accordance with a sixth embodiment of the present invention. The output signal resulted from the combination of LED and optical sensor (IR sensor) for infrared light produces the same levels as those in case of using the R sensor 14. Accordingly, it is impossible to discriminate between Ye and Mg. For the reason, in case of an ink sheet in which the 2nd color ink is Cy, the top position of the ink sheet 2 cannot be detected by the method which is adapted for sensing the border between the patches of 3rd and 1st colors. In this embodiment, therefore, the border between Cy 19 and Ye (i.e., the border between the patches of 2nd and 3rd colors) is first sensed while printing Then, while printing of 3rd color Ye 20, a transport length of the ink sheet 2 is measured during a transport length measuring period 109 in order to position the top color for a next image. Besides, assume that after positioning of 1st color Mg 18 the ink sheet cassette 15 is unloaded from the thermal transfer printer 1 and a new ink sheet cassette 15 is loaded. In this case, since the current position of the ink sheet 2 in the newly loaded ink sheet cassette 15 is indefinite, it is required to determine whether positioning of 1st color ink has been ended or not. In this embodiment, therefore, though the length of the ink sheet 2 for one image becomes waste, the ink sheet 2 is idly transported through that length. During this transporting, the border between Cy and Ye (i.e., between 2nd and 3rd colors of ink) in the subsequent region of the ink sheet is sensed to position 1st color ink. Note that when the ink sheet cassette 15 has been unloaded by the user from the thermal transfer printer 1, a set of color patches for a next image can be positioned without making any length of the ink sheet 2 waste even in this case, if the user manually rewinds the ink sheet 2 by a distance corresponding to at least one color patch and loads the ink sheet cassette 15 in such a condition that the Cy color patch on the ink sheet 2 can be seen through the window 259 (FIG. 15*d*) of the ink sheet cassette 15.

FIG. 14*b* is a side view showing an example of the above rewinding of the ink sheet 2 by the thermal transfer printer 1. A motor 55 is rotated immediately after loading the ink sheet cassette 15 into the thermal transfer printer 1. Then, torque of the motor 55 is transmitted to the supply spool 8 through a speed reducing gear 51 and a torque transmitting belt 50. The supply spool 8 is rotated in the direction of arrow D to rewind the ink sheet 2. The ink sheet 2 is rewound until the optical sensor 14 receiving light emitted from the LED 12 senses the transition point from Ye to Cy on the ink sheet 2 (i.e., turning point of the output signal from a high level to a low level). Thereafter, the top color is positioned by the method mentioned above in connection with FIG. 14*a*. Consequently, it becomes possible to position 1st color ink on any of the ink sheets 2 which have optional different color sequences.

In case of the embodiment illustrated in FIGS. 14*a* and 14*b*, if a black positioning mark 25 is formed between Ye and Mg (i.e., 3rd and 1st colors), the operation of positioning 1st color ink on the ink sheet 2 will not be affected because the rising edge 28 is sensed by the optical sensor 14 while printing of 2nd and 3rd colors of ink.

Figure 16A:
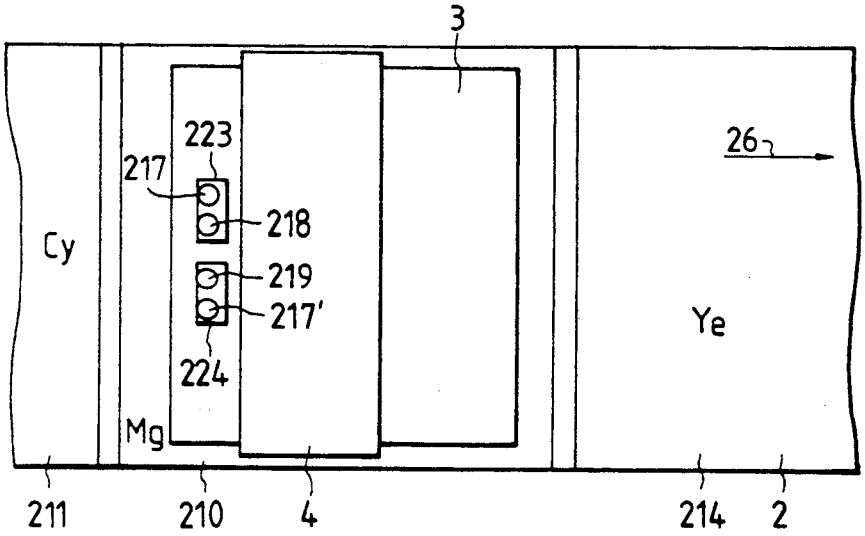
FIGS. 16*a* and 16*b* are explanatory views showing one example of a mechanism for discriminating the colors on the ink sheet.
Figure 16B:
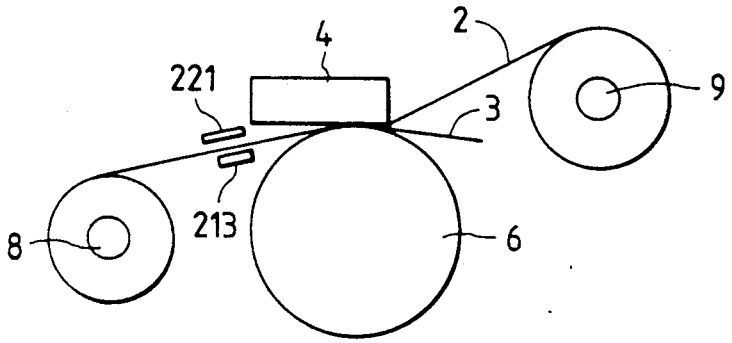

FIGS. 16*a* and 16*b* are explanatory views showing the case where the thermal transfer printer 1 equipped with two pairs of color sensors senses respective colors (Ye, Mg, Cy) on the ink sheet 2, in accordance with a seventh embodiment of the present invention. FIG. 16*a* is a plan view of a portion of the thermal transfer printer 1 as seen from above. FIG. 16*b* is a side view of FIG. 16*a*. This thermal transfer printer 1 is featured in providing a color discriminating unit 213 and a reflector plate 221 at a position between the supply spool 8 for supplying the ink sheet 2 and the thermal head 4 while sandwiching the ink sheet 2 in facing relation. Here, the color discriminating unit 213 comprises a color sensor 223 and a color sensor 224. The color sensor 223 is a combination of a visible light source 218 emitting red visible light and a light receiving element 217 for sensing visible light. Also, the color sensor 224 is a combination of a visible light source 219 emitting green visible light and a light receiving element 217' for sensing visible light. Note that the reflector plate 221 is disposed on the same side as the thermal head 4.

Figure 17A:
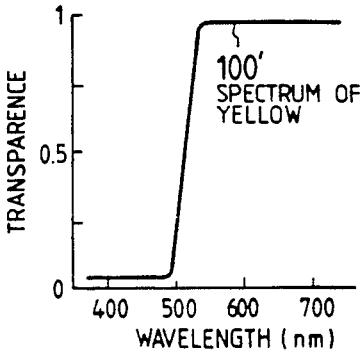
FIGS. 17*a*–17*f* are explanatory views showing examples of the relationship between wavelength and transparence of the ink sheet, spectra of sensor light sources and sensitivity of the sensor.
Figure 17D:
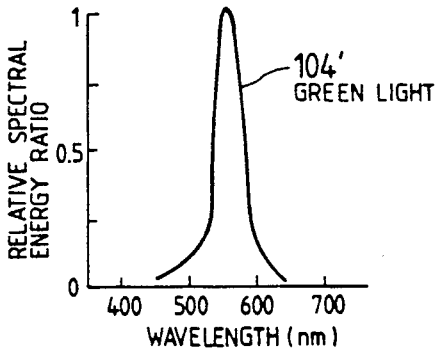
Figure 17B:
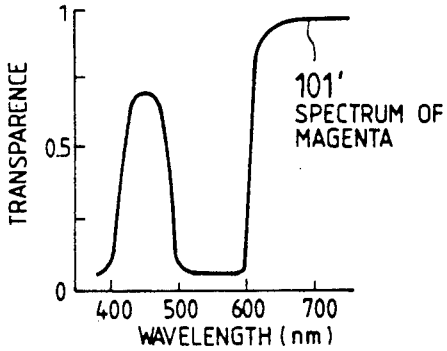
Figure 17E:
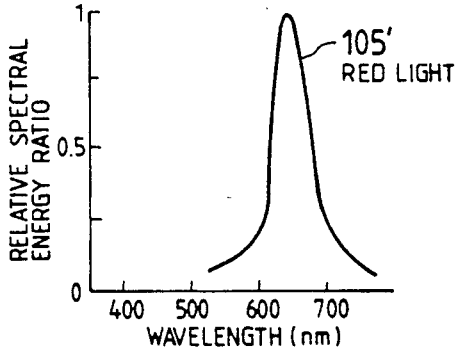
Figure 17C:
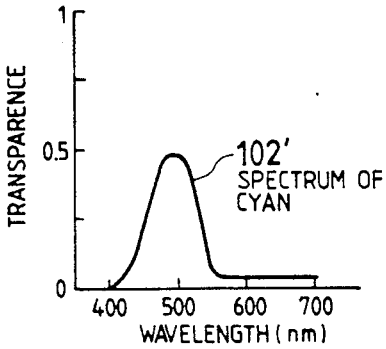

FIGS. 17*a*-17*f* are characteristic graphs showing examples of spectra of the actual ink sheet 2. Some of the ink sheets commonly used at present has less purity of colors and exhibits spectra shown in FIGS. 17*a*, 17*b* and 17*c* for respective color ink. FIG. 17*a* is a graph showing a spectrum (Ye spectrum) 100' of yellow ink. FIG. 17*b* is a graph showing a spectrum (Mg spectrum) 101' of magenta ink. FIG. 17*c* is a graph showing a spectrum (Cy spectrum) 102, of cyan ink. In case of this embodiment, for example, the spectrum of Ye ink shown in FIG. 17*a* is somewhat blunt in rising near wavelength of 500 nm. The spectrum of Mg ink shown in FIG. 17*b* is not fully peaked in a wavelength range of 400 nm-500 nm thereabout. Further, the spectrum of Cy ink shown in FIG. 17*c* has a very low peak in a wavelength range of 400 nm-600 nm and, particularly, has nearly zero level in a wavelength range of 500 nm-600 nm, thereby exhibiting a characteristic biased to blue.

Figure 17F:
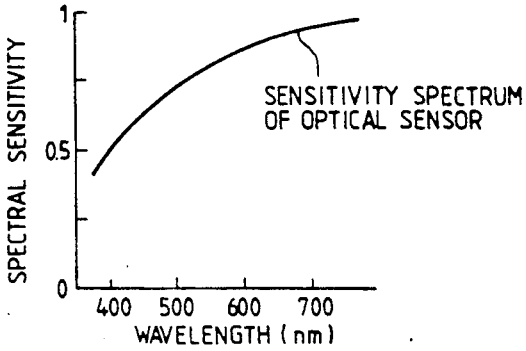

Moreover, FIGS. 17*d*-17*f* are graphs showing characteristics of the color sensors shown FIG. 16*a*. Specifically, FIG. 17*d* shows a spectrum of green visible light (G light) 104' emitted from the visible light source 219. FIG. 17*e* shows a spectrum of red visible light (R light) 105' emitted from the visible light source 218. FIG. 17*f* is a graph showing sensitivity versus wavelength of the light receiving element (optical sensor) 217, 217'.

Figures 18, 19:
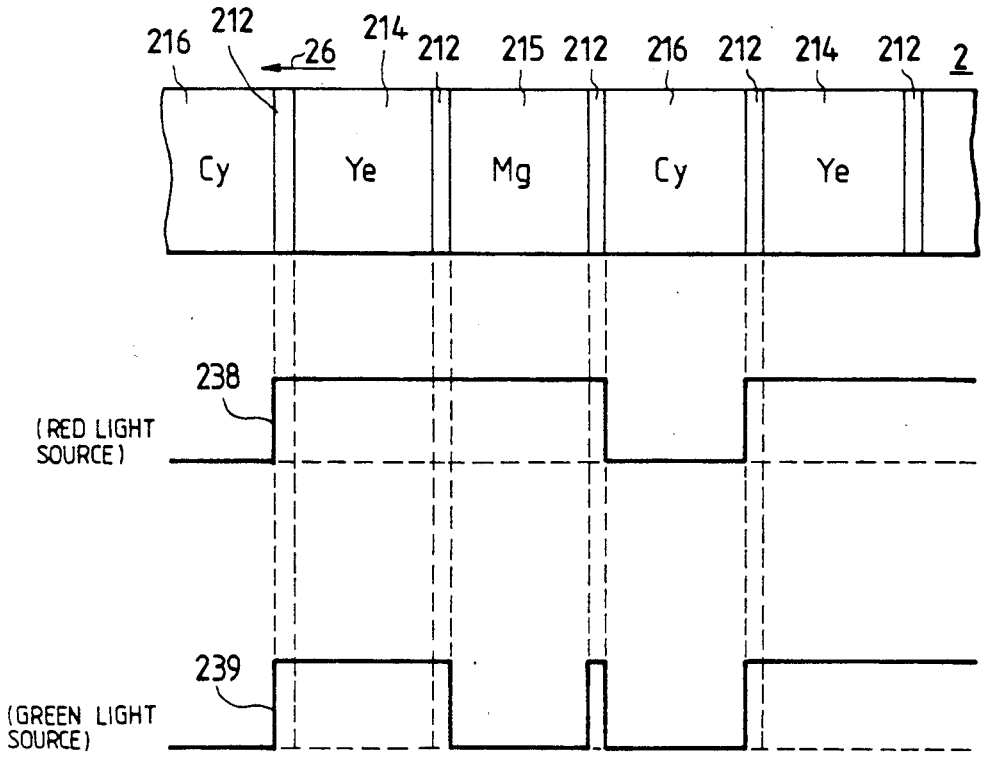
FIG. 18 is an explanatory view showing one example of output signals from the sensors dependent on the colors of light sources and the colors on the ink sheet.
FIG. 19 is an explanatory view showing output signals from the optical sensors.

FIG. 18 is a table showing the output result obtained upon the color discriminating unit 213 shown in FIG. 16*b* sensing the ink sheet 2 coated with three colors of ink which have their spectra shown in FIGS. 17*a*-17*c*, in accordance with an eighth embodiment of the present invention. The output result issued when the color discriminating unit 213 senses Ye ink and Mg ink is the same as that shown in FIGS. 13*a* and 13*b*. However, when the color discriminating unit 213 senses Cy ink, an output signal of the color sensor 224 becomes off (L level) because the green visible light emitted from the visible light source 219 has its peak nearly 560 nm and hence does not transmit through Cy ink.

FIG. 19 is a time chart showing output signals 38, 239 from the optical sensors 217, 217' when the ink sheet 2 having the spectra shown in FIGS. 17*a*-17*c* is sensed by the color discriminating unit 213 shown in FIG. 16*b*, in accordance with a ninth embodiment of the present invention. Each of the output signals 38, 239 is different from the output signal of FIG. 5*a* in that the falling edge appears at the front end of the patch of Cy ink 216 and the rising edge appears at the rear end of the patch of Cy ink 216. Dependent on types of the ink sheet 2, the similar difference may occur for Ye ink 214 and Mg ink 215 as well, in addition to Cy ink 216. Such cases can be handled by varying the operation algorithm utilized to position 1st color ink on the ink sheet 2 dependent on types of the ink sheet 2 used, or by restricting combinations of the ink sheet 2 accommodated in the ink sheet cassette and the thermal transfer printer 1. Incidentally, designated at 212 is a clear portion.

FIG. 20 is a view showing an example in which a positioning mark is placed on the ink sheet 2 by the use of printing ink, in accordance with a tenth embodiment of the present invention. Illustrated is the ink sheet 2 which is employed for printing by the use of all three colors (Ye, Mg, Cy) of ink. The positioning mark is also made up with these three colors of ink. As an ink coated cyclic pattern, a Ye region 306, a Mg region 307 and a Cy region 308 are successively coated on the ink sheet 2 corresponding to the color sequence for printing. A clear portion 305 is interposed between every adjacent regions 306-308. While one image is printed with a set three colors (Ye, Mg, Cy) repeatedly coated on the ink sheet 2, there is provided a marker region between one set of three regions 306-308 for printing one image and next a set of three regions for printing a next image. The marker region includes a Ye marker 302, a Mg marker 303 and a Cy marker 304 with the same color sequence as that of the three regions 306-308. Note that a clear portion 305 is interposed between every adjacent markers 302-304. The regions 306-308 used for printing have the same length. The markers 302–304 are also set equal in their length. Of course, the length of each of the markers 302–304 is set shorter than that of each of the regions 306–308 used for printing.

FIG. 21 is a block diagram showing an exemplified configuration of a top position discriminating circuit 367 for detecting the top position of the ink sheet 2 shown in FIG. 20, in accordance with an eleventh embodiment of the present invention. In FIG. 21, optical sensors 217, 217' are correspondent to the light receiving elements 217, 217' shown in FIG. 16*a*, respectively. Designated at 326 is a color discriminating circuit which issues output signals having logical levels shown in FIG. 13*b*. The color discriminating circuit 326 receives both an output signal 324 from the optical sensor 217 and an output signal 325 from the optical sensor 217', and then outputs a color code signal 327 relating to decision on the ink colors (Ye, Mg, Cy) and the clear portions. Designated at 328 is an edge detecting circuit which senses the rising edges 28, 29 shown in FIGS. 5*a*–5*c*, the falling edge 93 shown in FIGS. 11*a* and 11*b*, or the like. The edge detecting circuit 328 receives both the output signal 324 from the optical sensor 217 and the output signal 325 from the optical sensor 217', and detects the rising or falling edges of the applied signals. Then, the edge detecting circuit 328 outputs a trigger signal 329 in the form of a pulse in response to the edge detected result. Designated at 317 is a rotation detecting circuit which is correspondent to the FG generator 54 shown in FIG. 9*a*. The rotation detecting circuit 317 outputs a rotation signal 330 (i.e., FG signal 57) during rotation of the drum 6. Designated at 331 is a counter which is correspondent to the block diagram shown in FIG. 10*c* (though excepting the microcomputer 87). Upon receiving the trigger signal 329, the counter 331 starts counting pulses of the rotation signal 330 and then outputs a line number signal 332. Designated at 333 is a pattern discriminating circuit which is correspondent to the microcomputer 87 shown in FIG. 10*c*. The pattern discriminating circuit 333 receives the color code signal 327, the trigger signal 329 and the line number signal 332, and determines whether or not sensing of the top position of the ink sheet 2 accommodated in the ink sheet cassette has been completed. Then, the pattern discriminating circuit 333 outputs a top position signal 334 to an output terminal 318 of the top position detecting circuit 367.

Figure 22:
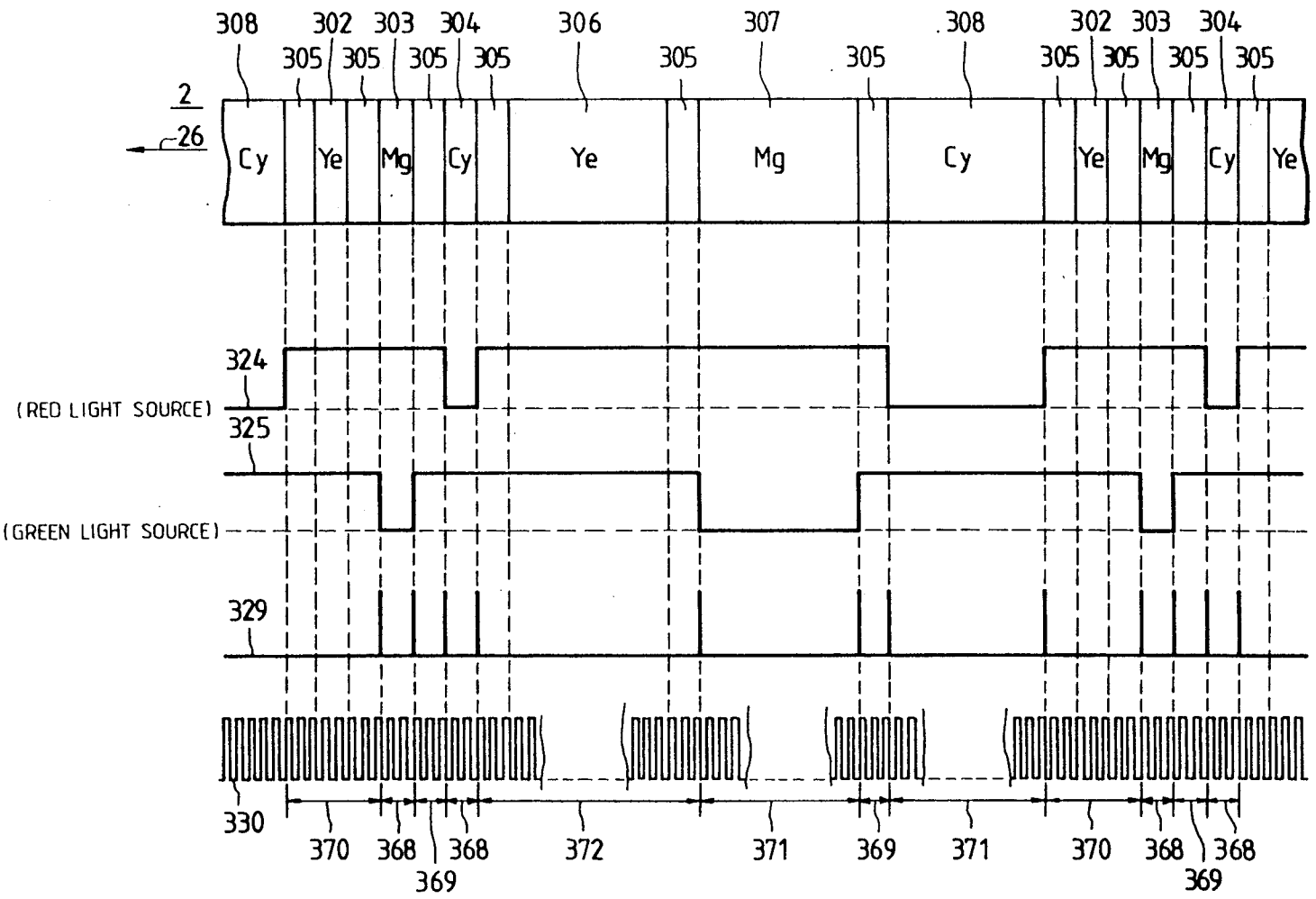
FIG. 22 is an explanatory view showing one example of output signals from the sensors for reading the ink coated pattern on the ink sheet shown in FIG. 20.

FIG. 22 is an explanatory view showing the ink sheet also illustrated in FIG. 20 and waveforms of the principal signals shown in FIG. 21 as obtained when the ink sheet is transported in the direction of arrow 26. In FIG. 22, designated at 368 is a line number period which indicates the number of lines corresponding to a length of the Mg marker 303 (or Cy marker 304). The pulses of the rotation signal 330 produced during the line number period 368 is counted by the counter 331, and the number of lines for the Mg marker 303 (or Cy marker 304) is read based on the counted value. Likewise, designated at 369 is a line number period corresponding to a length of the clear portion 305. Also, 370 is a line number period corresponding to a total length of the Ye marker 302 and the clear portions 205 on both sides. 371 is a line number period corresponding to a length of the Mg region 307 (or Cy region 308). 372 is a line number period corresponding to a total length of the Ye region 306 and the clear portions 305 on both sides.

The pattern discriminating circuit 333 shown in FIG. 21 discriminates the ink colors on the ink sheet 2 shown in FIG. 22 based on the output signals 324, 325 from the respective optical sensors. Simultaneously, the pattern discriminating circuit 333 also determines the number of lines for each of color regions (Ye, Mg, Cy and clear portions). By so doing, if the length of the ink coated pattern is given by the number of lines 370 (or thereabout), that ink coated pattern is determined as the Ye marker by the pattern discriminating circuit 333. If the length of the ink coated pattern is given by the number of lines 372 (or thereabout), that ink coated pattern is determined as the Ye region. The pattern discriminating circuit 333 makes the similar determination for combined patterns of the Ye, Mg, Cy markers and the clear portions 305, thereby to detect the top position of the ink sheet 2. Further, the pattern discriminating circuit 333 reads the color sequence of the ink sheet 2 from the mark indicating the top position of the ink sheet 2, the mark being made up by the three markers; Ye marker 302, Mg marker 303 and Cy marker 304. This embodiment is also advantageous in that the color sequence of the ink sheet 2 can be judged by the user upon merely looking at a top portion of the ink sheet 2. Though not illustrated, even if the mark indicating the top position of the ink sheet 2 is made up with only two colors of ink, e.g., 1st and 2nd colors of ink, the color sequence of three colors can be read because the remaining or 3rd ink color is automatically determined from the known two 1st and 2nd ink colors. Incidentally, 329 designates a trigger signal.

Figure 23:
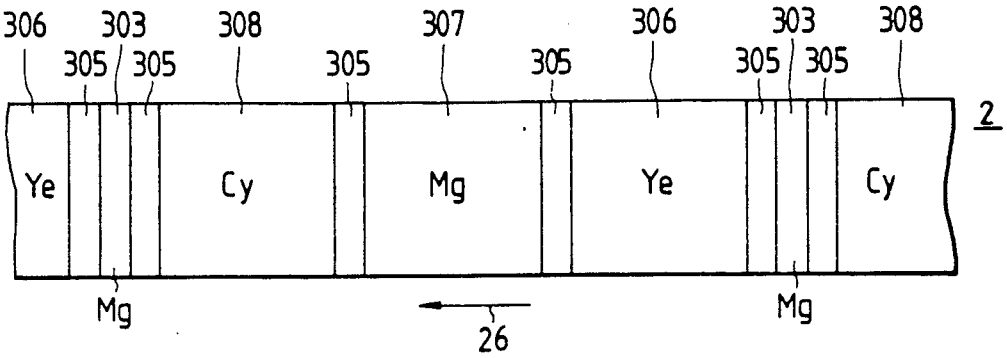
FIG. 23 is a plan view showing another embodiment of the ink sheet in which the positioning mark is made up with ink for printing.

FIG. 23 is a view showing an ink coated pattern on the ink sheet accommodated in the ink sheet cassette, in accordance with a twelfth embodiment of the present invention. In order to print each of color images by the use of three colors (Ye, Mg, Cy) of ink, a Cy region 308, a Mg region 307 and a Ye region 306 are successively coated on the ink sheet 2 corresponding to the color sequence for printing in a cyclic pattern. A clear portion 305 is interposed between every adjacent ink coated regions 306–308. Note that the color sequence for printing in FIG. 23 is given by the order of Cy, Mg and Ye. Further, there is provided a marker region between one set of three regions 306–308 for printing one image and a next set of three regions for printing a next image on the ink sheet 2. The marker region includes a Mg marker 303 with length shorter than that of each region 306–308. Here, the ink color of the Mg marker 303 is equal to the 2nd ink color in the color sequence for the three regions 306–308. If the 2nd ink color is other than Mg, the marker 303 can be changed in its color correspondingly The ink sheet 2 illustrated in FIG. 23 has the feature as mentioned above.

Figure 24:
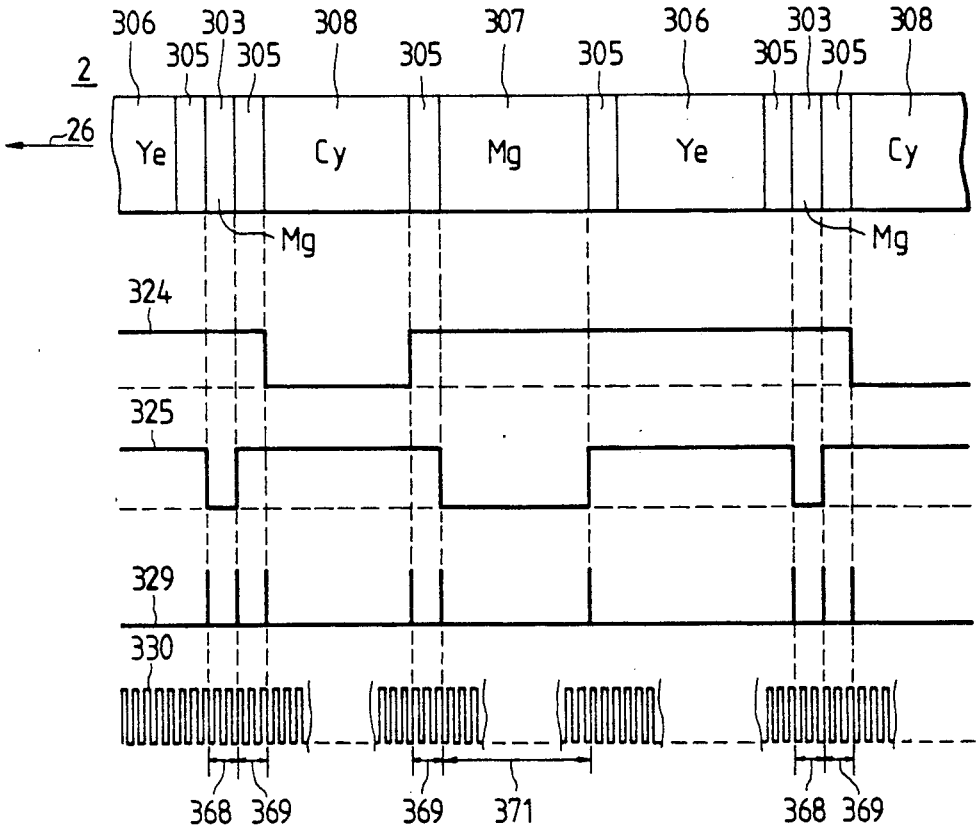
FIG. 24 is an explanatory view showing one example of output signals from the sensor for reading the ink coated pattern on the ink sheet shown in FIG. 20.

FIG. 24 is an explanatory view showing the ink sheet 2 also illustrated in FIG. 23 and waveforms of the principal signals shown in FIG. 21 as obtained when the ink sheet 2 is transported in the direction of arrow 26. The method of detecting the top position mark (Mg marker 303 in this embodiment) on the ink sheet 2 is similar to that in case of FIG. 22. Simultaneously, the pattern discriminating circuit 333 in FIG. 21 recognizes the color sequence on the ink sheet 2 by reading the color ahead of (or the colors on both sides of) the top position mark. Note that the pattern discriminating circuit 333 has a memory function to store the preceding ink color. With this embodiment, the top position mark is simpler and hence the reading algorithm necessary for the thermal transfer printer 1 is simplified. Another merit is that the cost of the ink sheet 2 is reduced because the top position mark has a narrower width on the ink sheet 2 of certain length.

Figure 25:
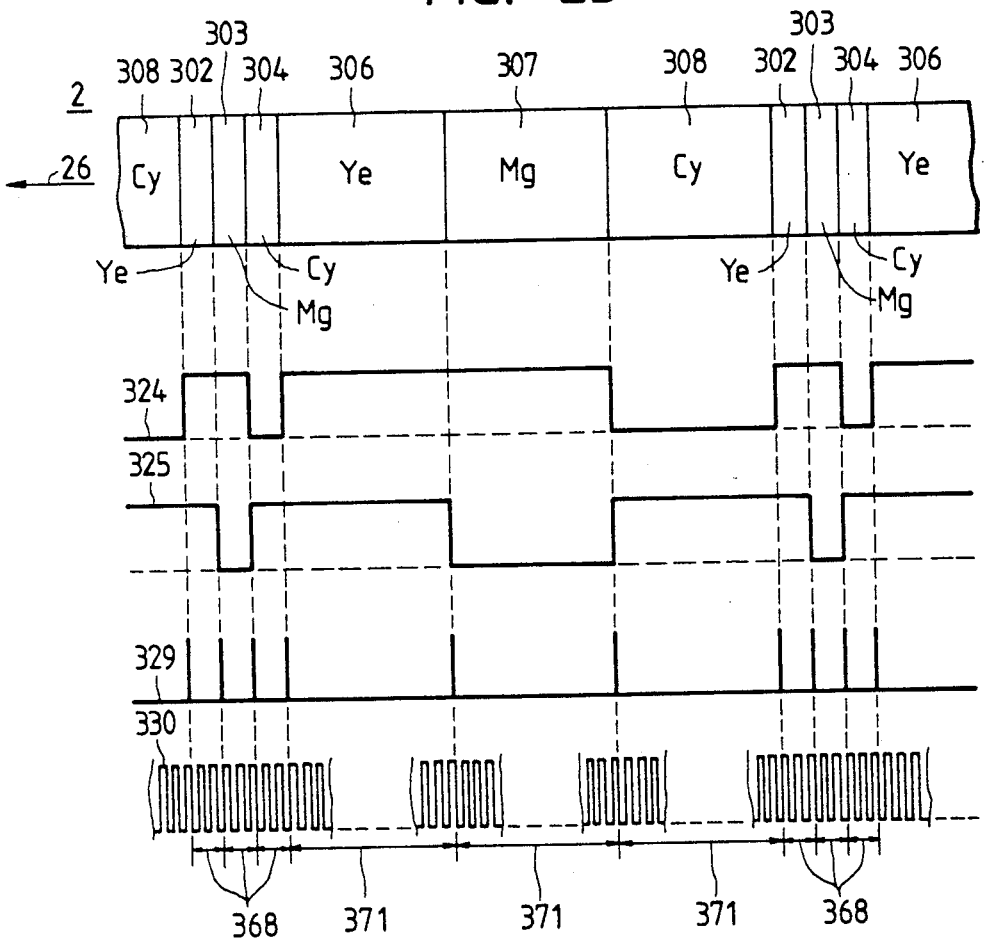
FIGS. 25–27 are explanatory views showing other embodiments of the present invention.

FIG. 25 is an explanatory view showing another example of the ink sheet 2 in which the clear portions 305 between every adjacent color regions (Ye, Mg, Cy) are omitted from the coated pattern on the ink sheet 2 shown in FIG. 20, in accordance with a thirteenth embodiment of the present invention. The principal signal waveforms for the top position detecting circuit 367 are omitted herein because they are substantially identical to those shown in FIG. 22. In this embodiment, since there present no clear portion 305, the algorithm detecting respective lengths of the ink coated patterns determines all Ye, Mg and Cy markers to be equal to each other. Accordingly, this embodiment is advantageous in simplifying the detection algorithm.

Although the foregoing embodiments have been illustrated as providing the marker regions in the form of lines fully extending across the width of the ink sheet 2, the equivalent effect can be obtained even when the marker areas are restricted to those areas on the ink sheet just facing the color sensors 223, 234 shown in FIG. 16*a*. However, the ink sheet 2 is usually manufactured in the form of a large-wide roll and then slit into plural strips of narrower width fit for being loaded into the thermal transfer printer 1. For the reason, the markers provided in the form of full-width lines could avoid the problem of mark reading error in the thermal transfer printer, even if the slit positions are fluctuated (or shifted). Also, with the markers provided in the form of fullwidth lines, even in case that the color sensors 223, 224 are moved due to improvement or other reasons.

Figure 26:
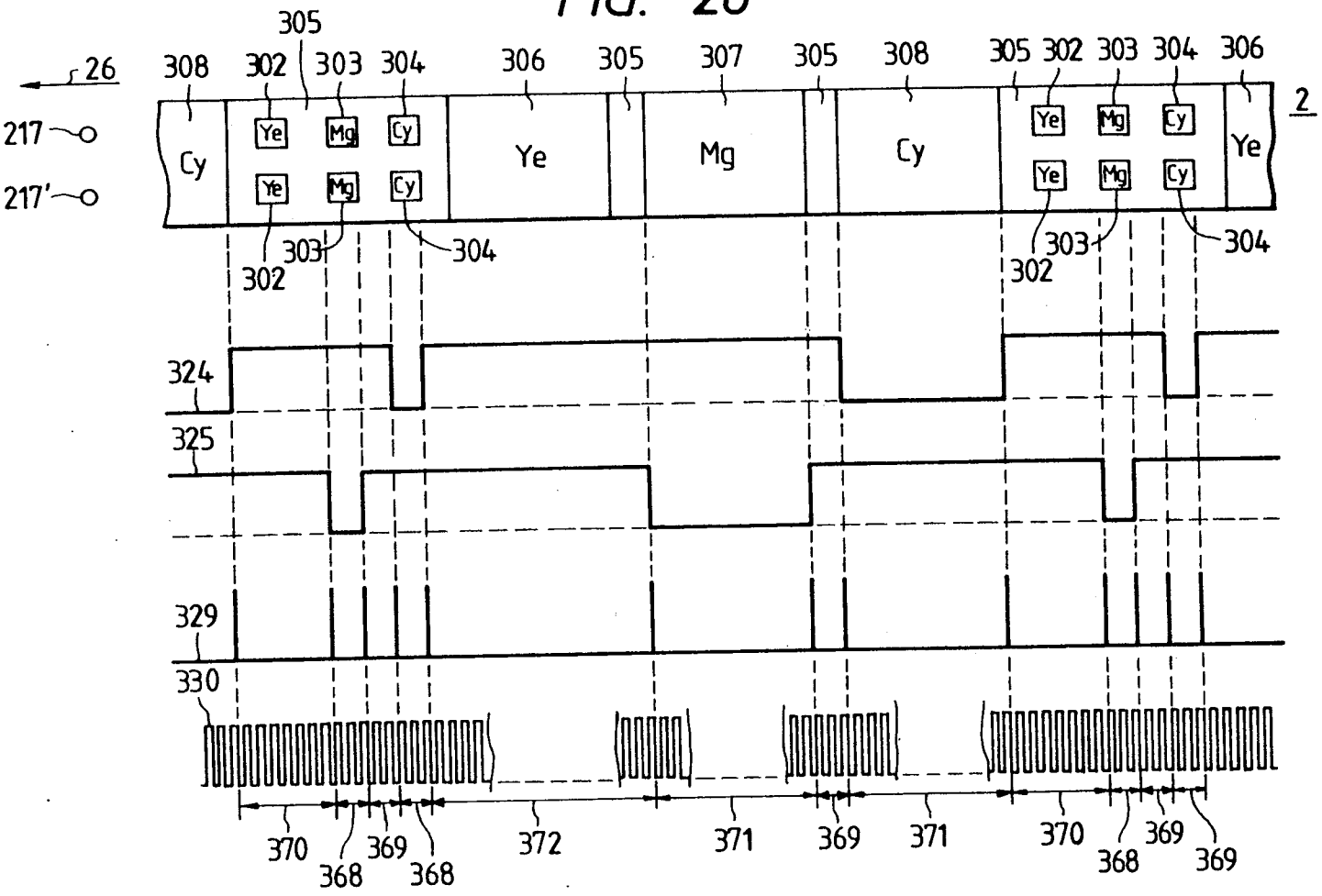

FIG. 26 is an explanatory view showing another ink coated pattern on the ink sheet accommodated in the ink sheet cassette, in accordance with a fourteenth embodiment of the present invention. This embodiment is different from the ink sheet 2 of FIG. 20 in that the coated areas of the markers 302–304 are restricted to those areas just facing the colors sensors 223, 224. In FIG. 26, the principal signal waveforms for the top position detecting circuit 367 shown in FIG. 21 are exactly the same as to those shown in FIG. 22. Accordingly, the top position of the ink sheet can be detected in exactly the same manner as employed for detecting that of the ink sheet 2 shown in FIG. 22.

Figure 27:
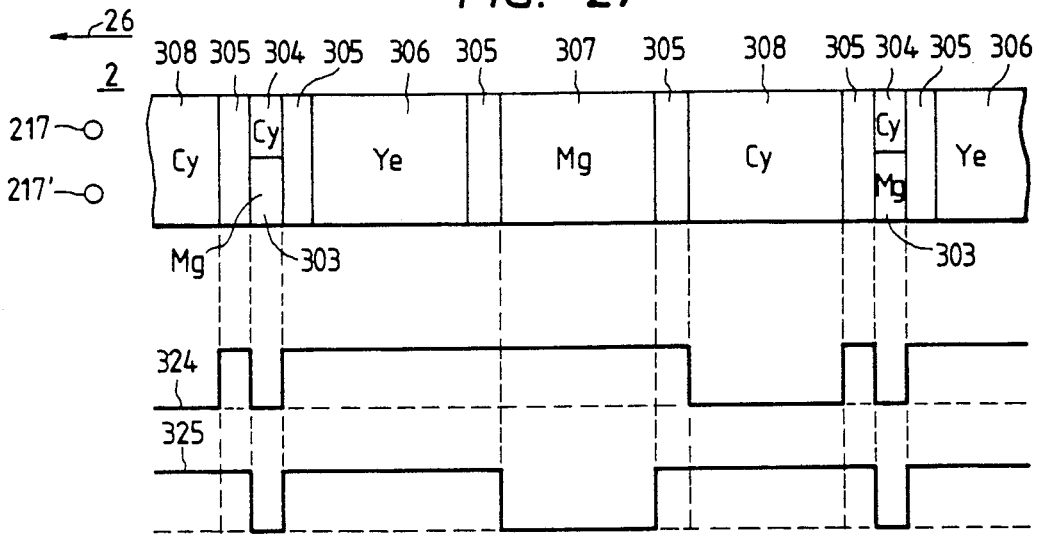

FIG. 27 is an explanatory view showing still another ink coated pattern on the ink sheet accommodated in the ink sheet cassette, in accordance with a fifteenth embodiment of the present invention. In FIG. 27, a Cy marker 304 and a Mg marker 303 are provided between one set of three regions 306–308 for printing one image and a next set of three regions for printing a next image on the ink sheet 2. Here, the Cy marker 304 is located on the ink sheet 2 at a position just facing the optical sensor 217. Also, the Mg marker 303 is located on the ink sheet 2 at a position just facing the optical sensor 217'. Thus, the Cy marker 304 and the Mg marker 303 are coated side by side in the widthwise direction of the ink sheet 2. In the waveforms of the output signals 324, 325 from the optical sensors, both of the two output signals 324, 325 assume a low level concurrently only when they detect the markers 303, 304, respectively. Therefore, the top position of the ink sheet 2 can be detected by taking logical OR of the output signals 324, 325 from the optical sensors. More specifically, an OR gate (not shown) is provided which receives the output signals 324, 325, and the top position of the ink sheet 2 is detected upon the OR gate issuing the output signal of a low level. Accordingly, the detection algorithm can be simplified with the embodiment of FIG. 27.

There will now be described the case that the thermal transfer printer 1 of the present invention employs an ink sheet (not shown) which has a positioning mark with black ink. When the optical sensors 217, 217' detect the black positioning mark, both of the output signals 324, 325 from the optical sensors assume a low level concurrently in a like manner to the above case. It is, therefore, possible to employ the thermal transfer printer 1 for detecting both of the positioning marks which includes black ink and no black ink. Thus, such two types of ink sheets 2 are the thermal transfer printer 1. Further, it will be understood that by arranging the optical sensor 14 shown in FIGS. 1*a* and 1*b* to detect only the Mg marker 303 as one of the positioning markers used in FIG. 27, the ink sheet 2 shown in FIG. 27 is replaceable with the ink sheet 2 shown in FIG. 4*a*.

Figure 28:
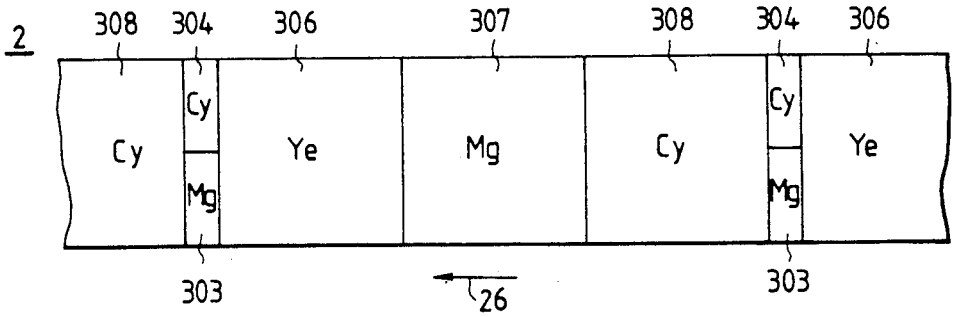
FIGS. 28–31 are explanatory views each showing another embodiment of the ink sheet in which the positioning mark is made up with ink for printing, and one example of an output signal from the sensor for reading the positioning mark.

FIG. 28 is an explanatory view showing still another ink coated pattern on the ink sheet accommodated in the ink sheet cassette, in accordance with a sixteenth embodiment of the present invention. In FIG. 28, the ink coated pattern on the ink sheet 2 is basically similar to that of FIG. 27. In the ink sheet 2 of this embodiment, the clear portions 305 shown in FIG. 27 are omitted. The method of detecting the positioning mark (consisted of a Cy marker 304 and a Mg marker 303) will not be explained here because it is the same as that in case of FIG. 27.

Figure 29:
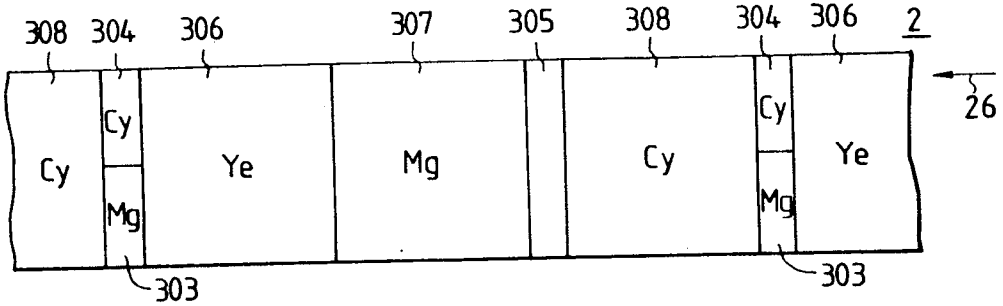

FIG. 29 is an explanatory view showing still another ink coated pattern on the ink sheet accommodated in the ink sheet cassette, in accordance with a seventeenth embodiment of the present invention. The ink coated pattern on the ink sheet 2 of FIG. 29 is basically similar to that of FIG. 28. The ink coated pattern on the ink sheet 2 of this embodiment is featured in providing a clear portion 305 between an Mg region 307 and a Cy region 308. In case of providing no clear portion 305, the Mg region 307 and the Cy region 308 may be overlapped with each other due to deterioration in the positioning accuracy during ink coating operation. This overlapped part (not shown) causes both of the output signals 324, 325 from the optical sensors shown in FIG. 27 to assume a low level. Therefore, the thermal transfer printer 1 may malfunction by erroneously detecting the overlapped part of both the regions 307, 308 as the positioning mark. The ink sheet shown in FIG. 29 can prevent the thermal transfer printer 1 from malfunctioning with provision of the clear portions 305.

Figure 30:
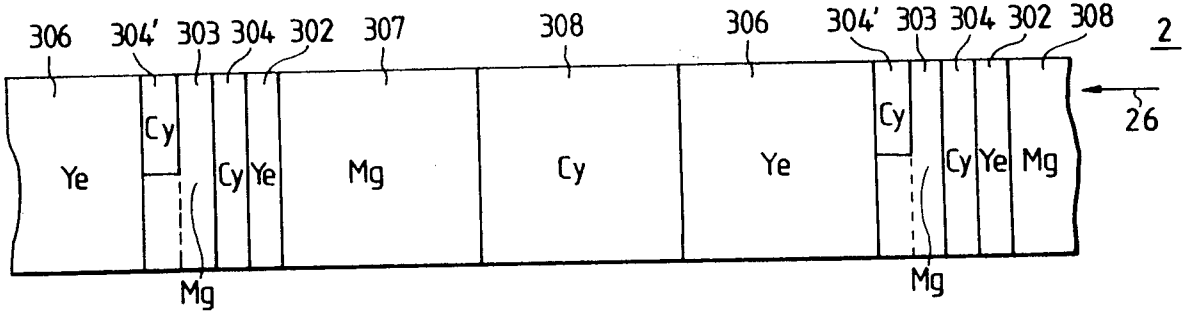

FIG. 30 is an explanatory view showing still another ink coated pattern on the ink sheet accommodated in the ink sheet cassette, in accordance with an eighteenth embodiment of the present invention. The ink sheet 2 of FIG. 30 includes, in the region of positioning mark, markers 302–304 coated with respective color ink in full-width of the ink sheet 2, and a marker 304' coated with ink in half-width of the ink sheet 2. In this embodiment, the thermal transfer printer 1 of the present invention shown in FIGS. 16*a*, 16*b* and 21 detects the top position of the ink sheet 2 upon both of the optical sensors issuing the output signals 324, 325 of low level concurrently. Then, the thermal transfer printer 1 detects the color sequence of three regions 306–308 for printing by reading the markers 302–304. This coated pattern (302–304, 304') in the region of positioning mark makes it possible to simplify the algorithm necessary for the top position detecting circuit 367 and to read the color sequence of the ink sheet 2 more easily.

Figure 31:
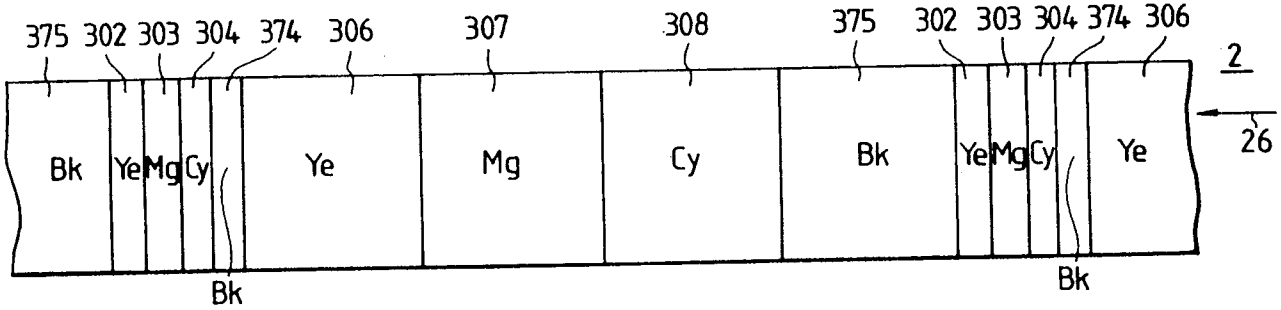

FIG. 31 is an explanatory view showing still another ink coated pattern on the ink sheet accommodated in the ink sheet cassette, in accordance with a nineteenth embodiment of the present invention. In FIG. 31, the ink coated pattern on the ink sheet 2 for printing consists of four colors of ink including black ink. This pattern is featured in that a positioning mark comprising 302 (Ye)–304 (Cy) and 374 (black) is provided between 1st Ye color marker 306 and 4th black color 375 among four color regions 306–308, 375 for printing. The method of reading the positioning mark will not be explained here because it is the same as that in case of FIG. 22. It will be apparent that by providing clear portions between every adjacent color ink regions (Ye, Mg, Cy, black) similarly to the ink sheet shown in FIG. 20, the thermal transfer printer 1 can be prevented from malfunctioning due to possible overlap of the adjacent ink regions.

In any of the foregoing embodiments, the thermal transfer printer of the present invention reads, by the optical sensor, information about the color sequence of three color regions on the ink sheet for printing, and then sets temperature distribution of the respective heating elements of the thermal head based on the read information, thereby to make printing in accordance with the three color regions.

According to the present invention, as described above, there can be provided the thermal transfer printer in which an ink sheet having separate regions coated with at least three colors of ink is employed in cooperation with printing paper to print an image, which printer can use both an ink sheet provided with a positioning mark to indicate the top position of a set of three regions necessary for producing one image, and an ink sheet provided with no such positioning mark, without the need of switching the operation mode.

The present invention can also provide the thermal transfer printer which does not require to provide separate color discriminating sensor for different colors, respectively, in order to position or initialize the 2nd and 3rd color ink regions on the ink sheet 2, and hence which is simple in construction and inexpensive.

According to the present invention, in an ink sheet employed in the thermal transfer printer equipped with a color discriminating sensor to discriminate the ink colors coated on the ink sheet, there can further provided an ink sheet cassette accommodating the ink sheet which does not require to coat specific color ink (black) for a positioning mark and is inexpensive, by forming a positioning mark (which is preferably in the belt-like form) with at least three colors of ink for printing at the top position in an area of the ink sheet corresponding to one image.

In addition, according to the present invention, since information about the color sequence of ink coated regions for printing is also recorded in a coated pattern of the positioning mark which is made up using the same colors of ink as those for printing, there can be provided an ink sheet cassette accommodating the ink sheet, which can transmit the above information to the thermal transfer printer. Furthermore, by previously accommodating the ink sheet in the ink sheet cassette as shown in FIGS. 3*a*–3*c* and 15*a*–15*d*, the ink sheet can be handled in the thermal transfer printer more readily.

What is claimed is:

1. A thermal transfer printer comprising:

an ink sheet cassette including a consumable ink sheet comprised of at least one of a first ink sheet and a second ink sheet, said first ink sheet having three regions coated with different color inks, respectively, and including gaps of a predetermined length between said regions, and said second ink sheet having a mark located before a first color region of said second ink sheet, said mark being indicative of a predetermined position of said second ink sheet;

transport means for transporting said consumable ink sheet to a selected position in said thermal transfer printer;

thermal transfer means including a thermal head for printing ink from said consumable ink sheet onto a printing paper; and ink color discriminating means for detecting an ink color on said consumable sheet, wherein said ink color discriminating means detects a color change between a first and a third color region on said first ink sheet and produces a first output signal indicative thereof when said first ink sheet is utilized as said consumable ink sheet, and said ink color discriminating means detects a color change between said mark and said first color region of said second ink sheet and produces a second output signal indicative thereof when said second ink sheet is utilized as said consumable ink sheet, and wherein said first output signal and said second output signal are equivalent to each other.

2. A thermal transfer printer according to claim 1, further comprising:

measuring means for measuring a transport length of said consumable ink sheet transported by said transport means and producing a signal indicative thereof, and wherein said transport means transports a top position of at least one of a second and said third color region of said consumable ink sheet to a predetermined position relative to said thermal transfer means when said first ink sheet is utilized as said consumable ink sheet, in response to said signal from said measuring means.

3. A thermal transfer printer according to claim 2, wherein said measuring means measures a transport length of said consumable ink sheet based on a rotation of at least one of a supply spool and a take-up spool; and wherein said transport means changes rotation of one of said supply spool and take-up spool dependent on a diameter of said consumable ink sheet on said supply spool so as to transport a constant length of said consumable ink sheet.

4. A thermal transfer printer according to claim 3, wherein said thermal transfer means moves said printing paper and said consumable ink sheet together while printing; and wherein said measuring means compares a movement length of said printing paper and said consumable ink sheet caused by said thermal transfer means with a rotation of one of said supply spool and said take-up spool while printing, and measures a diameter of said consumable ink sheet wound around one of said supply spool and said take-up spool.

5. A thermal transfer printer according to claim 1, wherein said ink color discriminating means incorporates at least one set of a light source for emitting monochromatic light and an optical sensor for receiving at least one of said monochromatic light and reflected light thereof.

6. A thermal transfer printer according to claim 5, wherein said light source emits light of a color corresponding to a complementary color of one ink color among said different colors of ink on said first ink sheet.

7. A thermal transfer printer according to claim 2, wherein colors of ink coated on said three regions of said first ink sheet are yellow, magenta and cyan;

wherein said mark on said second ink sheet is made up with at least one color of ink; and wherein said ink color discriminating means incorporates two light sources each emitting monochromatic light and respective optical sensors, in pair with said light sources, for receiving at least one of said monochromatic light and reflected light thereof, said two light sources emitting monochromatic light of different colors from each other.

8. A thermal transfer printer according to claim 7, wherein said two light sources separately emit monochromatic light in different colors corresponding to complementary colors of two of said three colors of said ink sheet.

9. A thermal transfer printer according to claim 7, wherein said two light sources and respective optical sensors have their optical axes set normal to a direction of transport of said consumable ink sheet.

10. A thermal transfer printer according to claim 9, wherein said mark on said second ink sheet comprises two blocks coated with two colors of ink among said three colors of ink, said blocks each having a length shorter than that of one image to be printed on said printing paper, and also having a width of half of said second ink sheet; and wherein said two light sources and respective optical sensors separately detect respective colors of the two blocks of said mark based on the output signal from said measuring means, and the top position is determined based upon the logical sum of respective output signals of said respective optical sensors.

11. A thermal transfer printer according to claim 9, wherein said mark on said second ink sheet comprises two block-like portions each having a half width of said second ink sheet and coated with different colors of ink, and at least one belt-like portion which is provided following said block-like portions and made up with at least one of said colors, yellow, magenta and cyan, of ink, said mark having a length shorter than that of one image to be printed on said printing paper;

wherein said ink color discriminating means discriminates said mark on said second ink sheet, thereby detecting an ink color sequence on a printing area of said second ink sheet and produces an output signal indicative thereof; and wherein said thermal transfer means controls a temperature distribution for a heating element of said thermal head in response to the output signal of said ink color discriminating means.

12. A thermal transfer printer according to claim 8, wherein said mark on said second ink sheet is comprises at least two belts having a length shorter than that of one image to be printed on said printing paper and coated with different colors of ink; and wherein said ink color discriminating means discriminates an ink pattern on said second ink sheet, thereby detecting a top position of a printing area, based on the signal of said measuring means.

13. A thermal transfer printer according to claim 12, wherein said mark on said second ink sheet comprises at least two belts of different color ink;

wherein said ink color discriminating means discriminates an ink pattern of said mark on said second ink sheet, thereby detecting an ink color sequence on said printing area of said second ink sheet and produces an output signal indicative thereof; and wherein said thermal transfer means controls a temperature distribution for a heating element of said thermal head in response to the output signal of said ink color discriminating means.

14 A thermal transfer printer according to claim 9, wherein said mark on said second ink sheet comprises a single belt having a length shorter than that of one image to be printed on said printing paper and is coated with a color of ink in a printing area of said second ink sheet;

wherein said ink color discriminating means discriminates and stores the ink colors on said second ink sheet and then discriminates the color stored immediately before said mark, thereby detecting an ink color sequence in a printing area of said second ink sheet, and produces an output signal indicative thereof; and wherein said thermal transfer means controls a temperature distribution for a heating element of said thermal head in response to the output signal of said ink color discriminating means.

15. A thermal transfer printer according to claim 5, wherein said mark on said second ink sheet is connected with a third color region on said second ink sheet through a small gap; and wherein said optical sensor has a light receiving opening directed on said second ink sheet which is set larger than said gap on said second ink sheet.

16. A thermal transfer printer comprising:

an ink sheet cassette including a consumable ink sheet comprised of at least one of a first ink sheet and a second ink sheet, said first ink sheet having three regions coated with different color inks, respectively, and including gaps of a predetermined length between said regions, and said second ink sheet having a mark located before a first color region of said second ink sheet, said mark being indicative of a predetermined position of said second ink sheet;

transport means for transporting said consumable ink sheet to a selected position in said thermal transfer printer;

thermal transfer means including a thermal head for printing ink from said consumable ink sheet onto a printing paper; and ink color discriminating means for detecting an ink color on said consumable sheet, wherein said ink color discriminating means detects a color change between said three regions on said first ink sheet and produces a first output signal indicative thereof when said first ink sheet is utilized as said consumable ink sheet, and said ink color discriminating means detects a color change between said mark and said first color region of said second ink sheet and produces a second output signal indicative thereof when said second sheet is utilized as said consumable ink sheet, wherein said first output signal and said second output signal are equivalent to each other, and wherein said ink color discriminating means further detects one border selected from at least one of a border between a first and second color region and a border between a second and third color region on said first ink sheet and produces a third output signal indicative thereof, said transport means being responsive to said third signal so as to transport said one border of said first ink sheet to a predetermined position.

17. A thermal transfer printer comprising:

a consumable ink sheet coated with ink, said consumable ink sheet comprising at least one of a first ink sheet and a second ink sheet, wherein said first ink sheet includes at least three regions each coated with a different color ink and having gaps of a predetermined length between each region, and said second ink sheet includes a mark located before a first color region thereof, said mark being indicative of a predetermined position of said consumable ink sheet;

transport means for transporting said consumable ink sheet to a selected position in said thermal transfer printer;

thermal transfer means including a thermal head for printing ink from said consumable ink sheet onto a printing paper; and ink color discriminating means for detecting an ink color on said consumable sheet, wherein said ink color discriminating means detects a color change between a first and a third color region on said first ink sheet and produces a first output signal indicative thereof when said first ink sheet is utilized as said consumable ink sheet, and said ink color discriminating means detects a color change between said mark and said first color region of said second ink sheet and produces a second output signal indicative thereof when said second ink sheet is utilized as said consumable ink sheet, and wherein said first output signal and said second output signal are equivalent to each other.

* * * * *